US010882319B2

(12) United States Patent
Tsubota

(10) Patent No.: US 10,882,319 B2
(45) Date of Patent: Jan. 5, 2021

(54) LIQUID EJECTING APPARATUS

(71) Applicant: SEIKO EPSON CORPORATION, Tokyo (JP)

(72) Inventor: Shinichi Tsubota, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/533,968

(22) Filed: Aug. 7, 2019

(65) Prior Publication Data

US 2020/0047504 A1 Feb. 13, 2020

(30) Foreign Application Priority Data

Aug. 9, 2018 (JP) ..... 2018-150137

(51) Int. Cl.
*B41J 2/165* (2006.01)
*B41J 2/045* (2006.01)

(52) U.S. Cl.
CPC ..... *B41J 2/16505* (2013.01); *B41J 2/16526* (2013.01); *B41J 2/04596* (2013.01)

(58) Field of Classification Search
CPC .... B41J 2/175; B41J 2/16544; B41J 2/16526; B41J 2/1752; B41J 2/17553; B41J 2/1721; B41J 2/17509; B41J 29/02; B41J 29/17; B41J 2/18; B41J 2/16555; B41J 2/16517; B41J 2/16585; B41J 2/16505; B41J 2/17513; B41J 2002/1655; B41J 2/04596
See application file for complete search history.

(56) References Cited

U.S. PATENT DOCUMENTS 7,252,362 B2 * 8/2007 Katsu ..... B41J 2/16526 347/22
2015/0306878 A1 10/2015 Sawase
2015/0360464 A1 12/2015 Katsumura et al.

FOREIGN PATENT DOCUMENTS

| | | |
|---|---|---|
| JP | 2009-045803 | 3/2009 |
| JP | 2010-036382 | 2/2010 |
| JP | 2014-208424 | 11/2014 |
| JP | 2015-208870 | 11/2015 |

* cited by examiner

*Primary Examiner* — Thinh H Nguyen
(74) *Attorney, Agent, or Firm* — Workman Nydegger

(57) ABSTRACT

A liquid ejecting apparatus carries out preliminary discharging in which the liquid is discharged from nozzle rows toward a cap. In preliminary discharging, the liquid ejecting apparatus intermittently carries out concurrent discharging and concurrent non-discharging from the nozzles in the first nozzle row and the second nozzle row in such a way that when concurrent discharging is performed from the nozzles in the first nozzle row, concurrent non-discharging from the nozzles in the second nozzle row is performed, and when concurrent discharging is performed from the nozzles in the second nozzle row, concurrent non-discharging from the nozzles in the first nozzle row is performed.

7 Claims, 13 Drawing Sheets

LIQUID EJECTING APPARATUS

The present application is based on, and claims priority from JP Application Serial Number 2018-150137, filed Aug. 9, 2018, the disclosure of which is hereby incorporated by reference herein in its entirety.

BACKGROUND

Technical Field

The present disclosure relates to a liquid ejecting apparatus having a plurality of nozzle rows in each of which nozzles that discharge a liquid are disposed in a row, and more particularly to an ink jet recording apparatus that discharges an ink as a liquid.

Related Art

As a liquid ejecting apparatus, an ink jet recoding apparatus, for example, is known that discharges ink droplets as a liquid to perform printing on a liquid-ejected medium such as paper or a recording sheet.

With an ink jet recording apparatus, when an ink in a nozzle that discharges ink droplets dries and becomes more viscous, the viscous ink causes a deviation in a direction in which ink droplets fly, nozzle clogging, or another discharging failure. Therefore, to moisten the interior of a cap that covers a liquid ejection surface in which nozzles are formed, preliminary discharging (also referred to as flushing) is performed in which ink droplets are discharged from the nozzles toward the interior of the cap.

When mist is generated during this type of preliminary discharging, the generated mist may adhere to the liquid ejection surface and meniscuses formed in the nozzles in liquid ejection surface may be destroyed, which may cause an deviation in a direction in which ink droplets fly or a discharging failure of ink droplets. This may lower printing quality.

In view of this, a method is proposed in which ink droplets are not discharged from a plurality of nozzle rows at the same time but the timing of preliminary discharging is made different among the nozzle rows to reduce mist (see JP-A-2015-208870, for example).

Even when the timing of preliminary discharging is made different among the nozzle rows as in JP-A-2015-208870, however, an air flow that causes mist is likely to be generated, so mist cannot be reduced. This is problematic in that the discharging failure of ink droplets cannot be eliminated.

This type of problem is not limited an ink jet recording apparatus. The problem also arises in a liquid ejecting apparatus that ejects a liquid other than an ink, as in an ink jet recording apparatus.

SUMMARY

The present disclosure addresses this situation with the object of providing a liquid ejecting apparatus that suppresses the adhesion of mist to a liquid ejection surface in preliminary discharging to suppress a discharging failure.

An aspect of the present disclosure that addresses the above problem is a liquid ejecting apparatus that includes: a liquid ejecting head having a plurality of nozzle rows in which nozzles that discharge a liquid are arranged in rows; a pressure generating unit that causes a pressure change in a flow path communicating with the nozzles so that the liquid is discharged from the nozzles; a cap that covers the plurality of nozzle rows; and a controller that controls the driving of the pressure generating unit and causes the liquid to be ejected from the nozzles. The controller carries out preliminary discharging in which the liquid is discharged from the plurality of nozzle rows toward the cap. The controller also controls a first preliminary discharging mode so as to be executable so that, in preliminary discharging from the first nozzle row and second nozzle row constituting the plurality of nozzle rows, the controller intermittently carries out concurrent discharging and concurrent non-discharging from the nozzles in the first nozzle row and the second nozzle row in such a way that when concurrent discharging is performed from the nozzles in the first nozzle row, concurrent non-discharging from the nozzles in the second nozzle row is performed, and when concurrent discharging is performed from the nozzles in the second nozzle row, concurrent non-discharging from the nozzles in the first nozzle row is performed.

DESCRIPTION OF EXEMPLARY EMBODIMENTS

Figure 1:
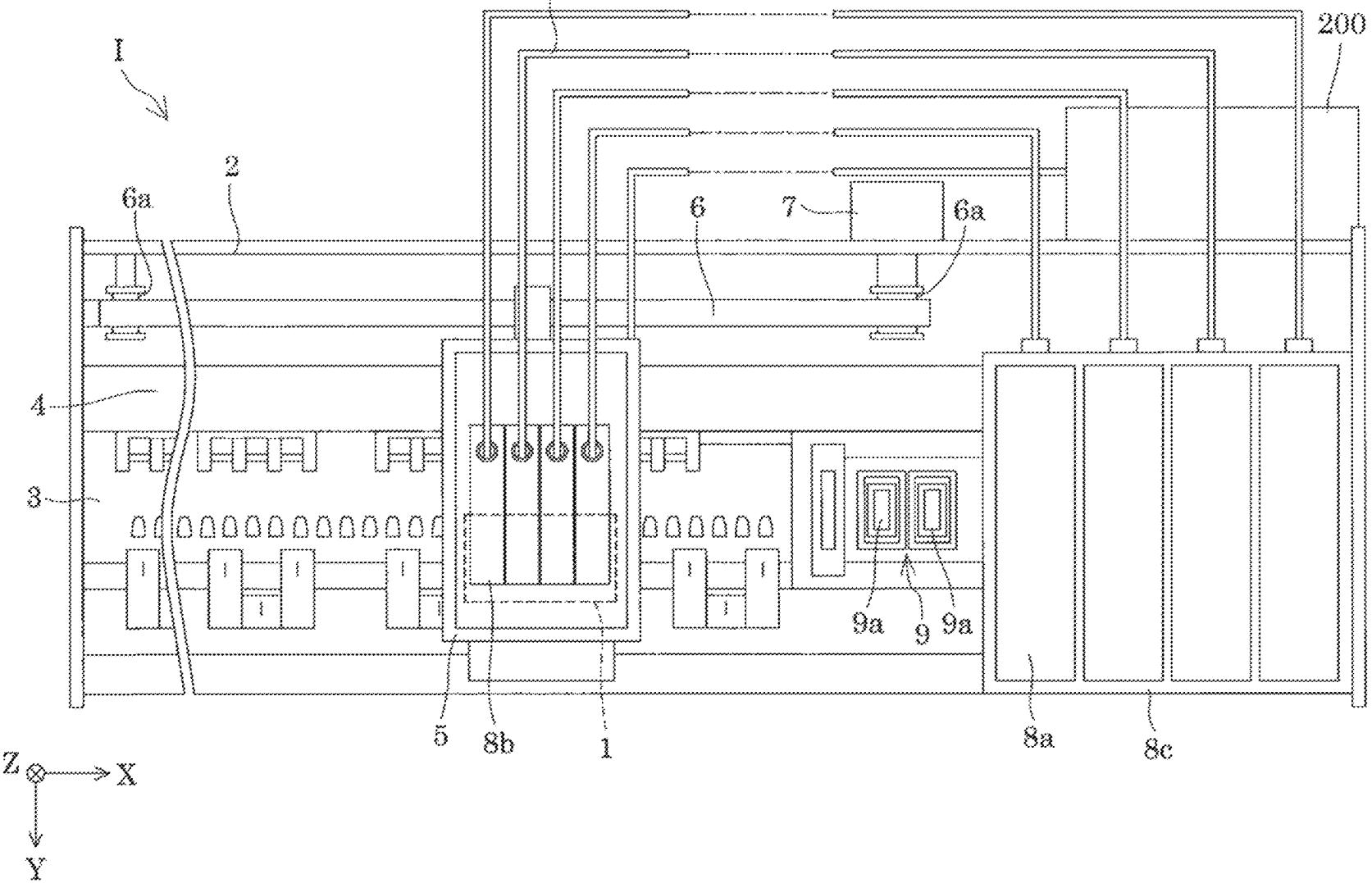
FIG. 1 generally illustrates the structure of a recording apparatus according to a first embodiment.

The present disclosure will be described below according to embodiments. However, the description below indicates only an aspect of the present disclosure and can thereby be arbitrarily modified. Like members in the drawings are indicated by like reference characters, and the description of these members will be appropriately omitted. X, Y, and Z in the drawings represent three spatial axes that are mutually orthogonal. In this specification, directions along these axes will be referred to as a first direction X, a second direction Y, and a third direction Z. The third direction Z is the vertical direction. The lower side in the vertical direction will be referred to as the Z1 side, and the upper side of the vertical direction will be referred to as the Z2 side.

First Embodiment

FIG. 1 generally illustrates the structure of an ink jet recording apparatus, which is an example of a liquid ejecting apparatus according to a first embodiment of the present disclosure.

As illustrated in FIG. 1, the ink jet recording apparatus I has a main body frame 2, which is in a rectangular shape in plan view. In the main body frame 2, a medium support member 3 extends in a main scanning direction, which is the first direction X. The medium support member 3 supports a liquid-ejected medium (not illustrated), such as paper or a recording sheet, onto which ink droplets are landed. On the medium support member 3, the liquid-ejected medium is supplied along a sub-scanning direction, which is the second direction Y, by a paper-feeding mechanism (not illustrated). A guide shaft 4 like a bar, which extends in parallel to the first direction X, is provided above the medium support member 3 in the main body frame 2.

A carriage 5 is supported to the guide shaft 4 in a state in which the carriage 5 can reciprocate in the first direction X along the guide shaft 4. The carriage 5 is linked to a carriage motor 7 provided in the main body frame 2 through a timing belt 6, which is an endless belt, placed between a pair of pulleys 6*a* provided in the main body frame 2. Thus, the carriage 5 is reciprocated by the driving of the carriage motor 7 along the guide shaft 4.

An ink jet recording head 1 (also referred to below simply as a recording head 1) and a temporary holding tank 8*b* are mounted in the carriage 5. The recording head 1 is an example of a liquid ejecting head in this embodiment. The temporary holding tank 8*b* is a flow path member from which an ink from an ink tank 8*a*, which is a liquid holding unit, is supplied to the recording head 1. In this embodiment, four temporary holding tanks 8*b* are retained in the carriage 5. Although described later in detail, four nozzle rows are provided in the recording head 1.

A tank holder 8*c* is provided at one end of the main body frame 2 in the first direction X. A plurality of ink tanks 8*a*, each of which is a liquid holding unit, are removably mounted in the tank holder 8*c*. In this embodiment, four ink tanks 8*a* are provided. Different types of inks such as, for example, inks in different colors are stored in the ink tanks 8*a*.

Each ink tank 8*a* mounted in the tank holder 8*c* is coupled to the relevant temporary holding tank 8*b* through a supply pipe 8*d* such as a tube. Each temporary holding tank 8*b* temporarily holds an ink in a different color that was supplied from the relevant ink tank 8*a* through the supply pipe 8*d*. Inks in different colors that are temporarily held individually are supplied to the recording head 1.

A maintenance unit 9 that performs maintenance such as cleaning for the recording head 1 is provided in a home position region of the carriage 5 at a position comparatively near one end in the main body frame 2 in the first direction X. This maintenance unit 9 has caps 9*a* and a suction pump (not illustrated) that can withdraw air from the interiors of the caps 9*a*. The caps 9*a* abut the recording head 1 so as to enclose the nozzles 21 in the recording head 1 and receive inks discharged from the nozzles 21 in preliminary discharging.

In this embodiment, the recording head 1 has two head chips in the second direction Y. Each head chip includes two nozzle rows in the second direction Y, in each of which nozzles 21 are arranged in a row in the first direction X. The cap 9*a* is provided separately for each head chip. That is, as many caps 9*a* as there are head chips, that is, a total of two caps 9*a*, are provided. This will be described later in detail.

In a state in which the caps 9*a* abut the recording head 1 so as to enclose the nozzles 21 in the recording head 1, the maintenance unit 9 having these caps 9*a* performs so-called cleaning in which when the maintenance unit 9 withdraws air in each cap 9*a* with the suction pump to forcibly exhaust viscous ink and bubbles from each nozzle 21 into the interior of the cap 9*a*. While waiting for printing, the maintenance unit 9 covers the nozzles 21 with the caps 9*a* to restrain inks in the vicinity of the nozzles 21 from being dried. In this embodiment, when the nozzles 21 are covered with the cap 9*a*, preliminary discharging in a first preliminary discharging mode to moisten the interior of the cap 9*a* is performed. This will be described later in detail. Also in this embodiment, preliminary discharging in a second preliminary discharging mode to discharge ink droplets into the cap 9*a* is performed before printing starts or at periodic timings during, for example, printing.

Figure 2:
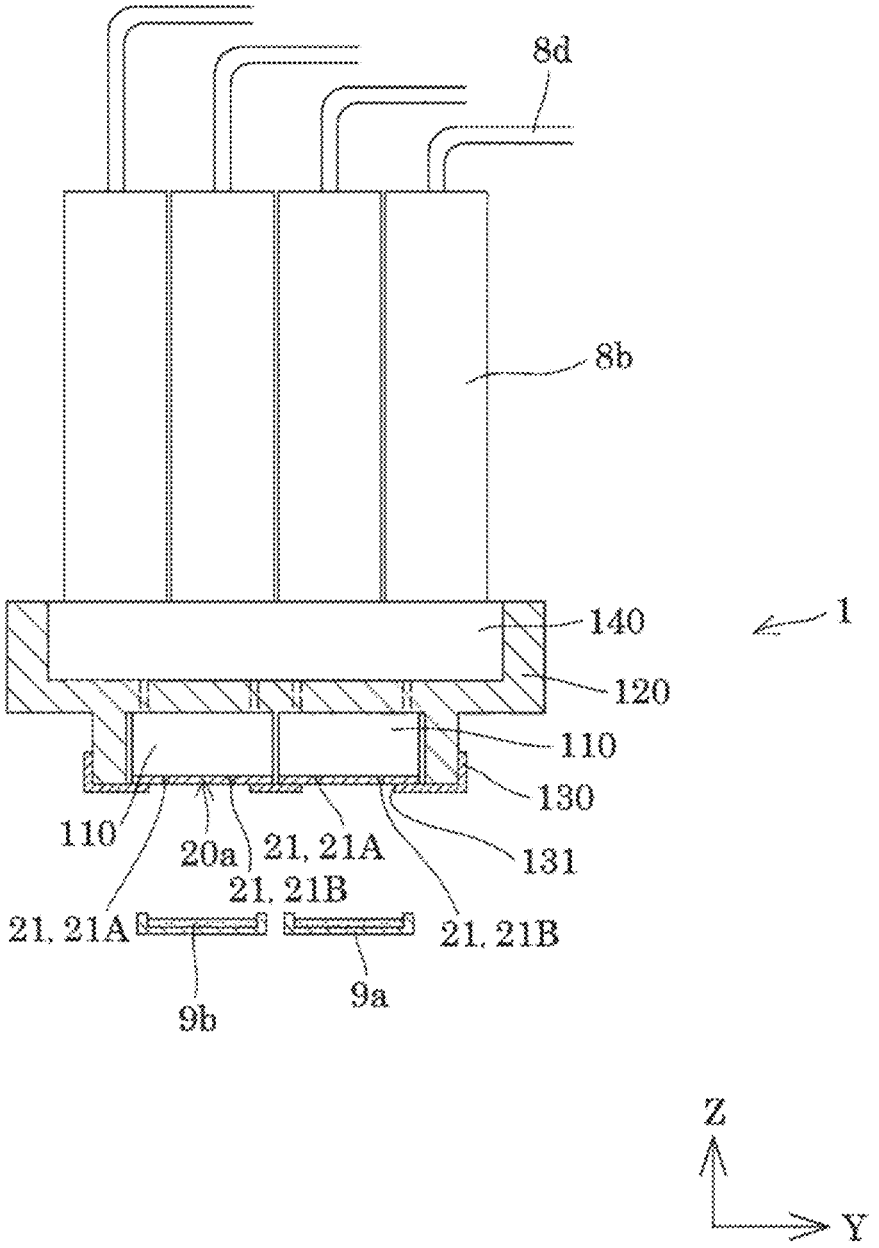
FIG. 2 is a main element cross-sectional view of a temporary storage tank, a recording head, and a cap according to the first embodiment.

Now, an example of the ink jet recording head 1, which is the liquid ejecting head in this embodiment, will be described with reference to FIG. 2. FIG. 2 is a main element cross-sectional view of the temporary storage tank 8*b*, ink jet recoding head 1, and cap 9*a* according to the first embodiment.

As illustrated in FIG. 2, the recording head 1 has head chips 110, in each of which nozzles 21 are provided. In this embodiment, two nozzle rows are arranged side by side in the second direction Y in one head chip 110. In each nozzle row, nozzles 21, which discharge ink droplets, are arranged in a row in the first direction X. This will be described later in detail. In this embodiment, one nozzle row in one head chip 110 will be referred to as a first nozzle row 21A and the other nozzle row will be referred to as a second nozzle row 21B.

Two head chips 110 are held in a holder 120 in a state in which they are arranged side by side in the second direction Y, in which the first nozzle row 21A and second nozzle row 21B are arranged side by side.

The holder 120, which holds two head chips 110, is fixed to the carriage 5. A flow path (not illustrated) is formed in the holder 120.

A liquid ejection surface in which the nozzles 21 in the two head chips 110 provided in the holder 120 are formed is covered by the cover head 130. The cover head 130 has, in a region opposite to the nozzles 21, an exposure opening 131 passing through the cover head 130 in its thickness direction. The nozzles 21 are exposed to the outside through the exposure opening 131. Although, in this embodiment, a single cover head 130 covers the liquid ejection surfaces of the two head chips 110 in common, this is not a limitation. One independent cover head 130 may be provided for each head chip 110.

In the holder 120, a flow path member 140 is provided. The flow path member 140 internally has flow paths (not illustrated) through which inks are supplied from the temporary holding tanks 8*b* to the head chips 110. A filter that captures dust and bubbles included in the ink or another functional member may be provided at an intermediate point in each flow path in the flow path member 140.

Figure 3:
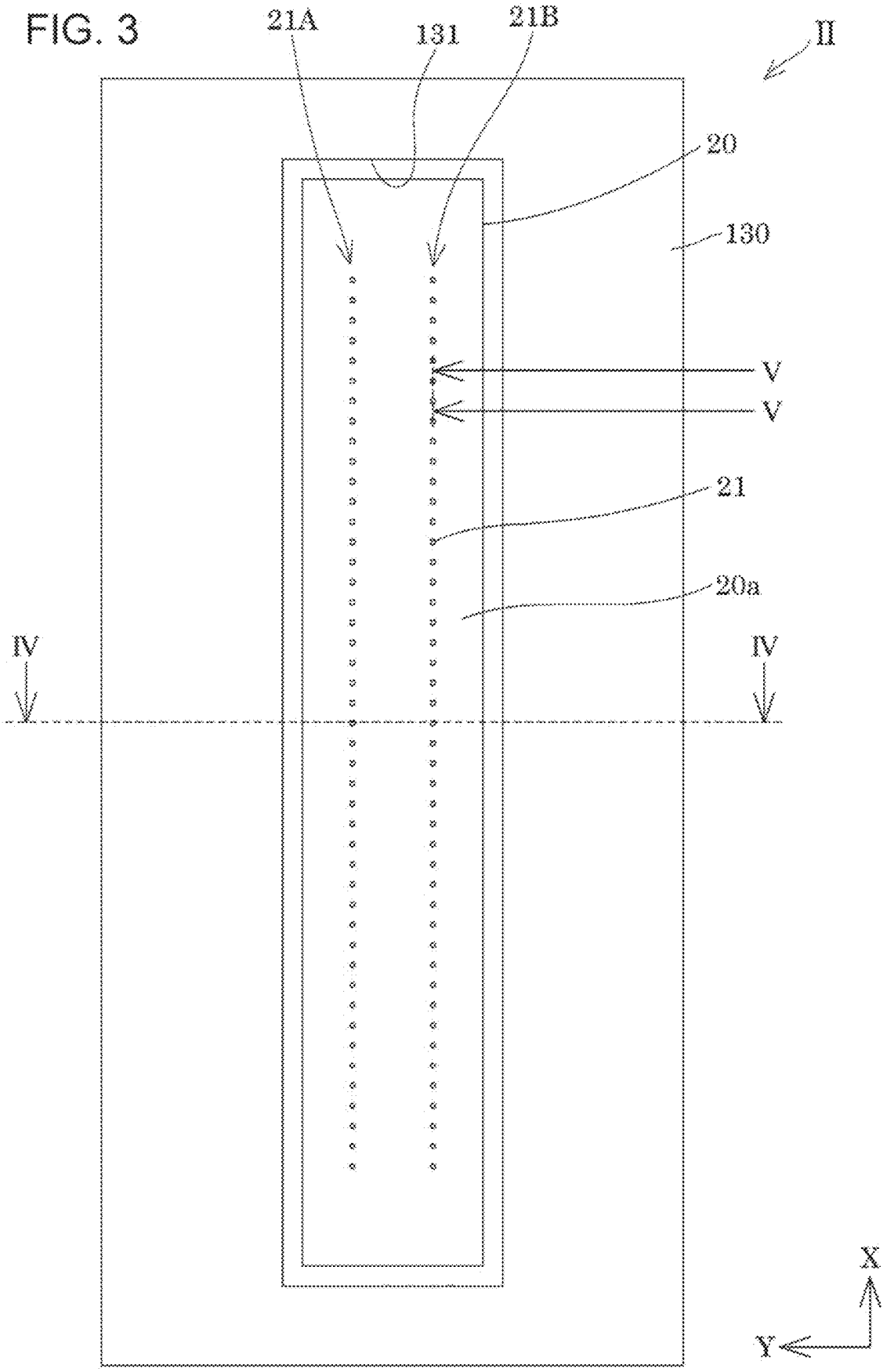
FIG. 3 is a plan view of a head chip according to the first embodiment.
Figure 4:
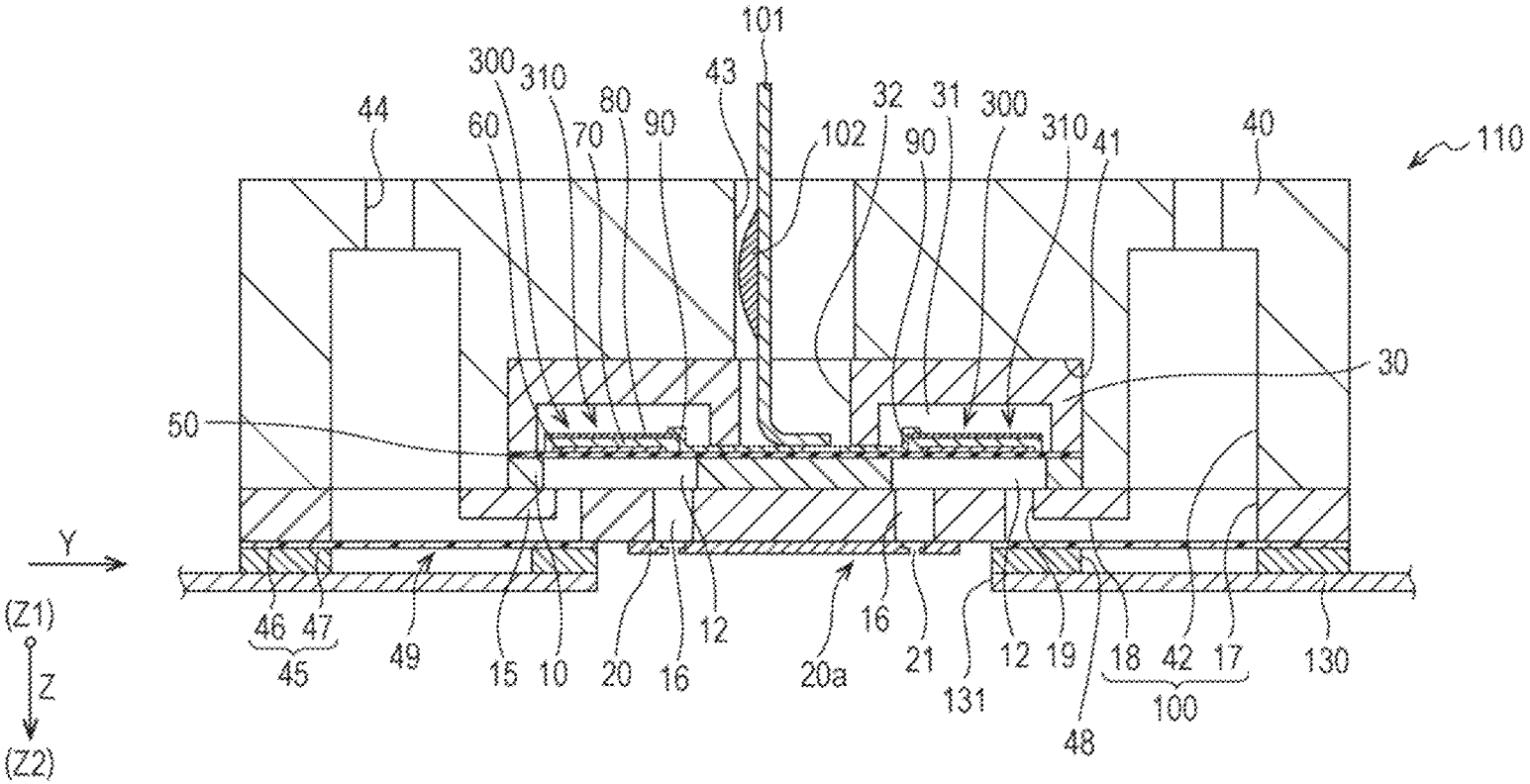
FIG. 4 is a cross-sectional view of the head chip according to the first embodiment.
Figure 5:
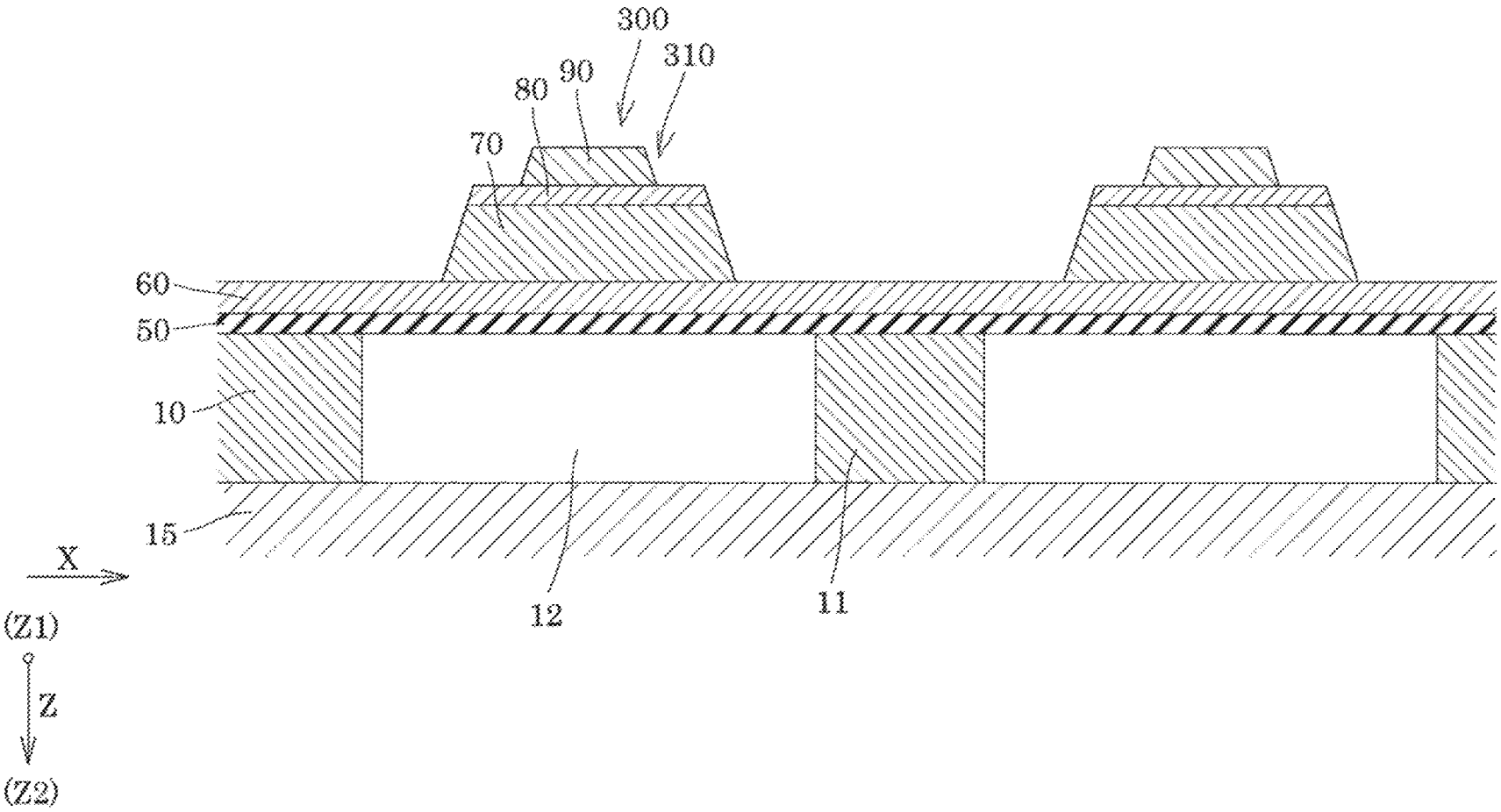
FIG. 5 is another cross-sectional view of the head chip according to the first embodiment.

Now, an example of the head chip 110 in this embodiment will be described. FIG. 3 is a plan view of the head chip 110 on the liquid ejection surface side. FIG. 4 is a cross-sectional view taken along line IV-IV in FIG. 3, and FIG. 5 is a cross-sectional view taken along line V-V in FIG. 3. In this embodiment, directions of the head chip 110 will be described according to directions when the head chip 110 is mounted in the ink jet recording apparatus I. Of course, the placement of the head chip 110 in the ink jet recording apparatus I is not limited to the placement described below.

A flow path forming substrate 10 included in the head chip 110 is formed from a monocrystalline silicon substrate, and a vibrating plate 50 is provided on one surface of the flow path forming substrate 10, as illustrated in FIGS. 3 to 5. The vibrating plate 50 may be a single layer selected from a silicon dioxide layer and zirconium oxide layer or a laminated layer.

In the flow path forming substrate 10, pressure generating chambers 12 are separated by a plurality of partition walls 11 by performing anisotropic etching from the other surface, as illustrated in FIG. 5. These pressure generating chambers 12 are arranged in a row along the first direction X. A plurality of rows of pressure generating chambers 12, in each of which pressure generating chambers 12 are arranged in a row in the first direction X, are also provided in the second direction Y in the flow path forming substrate 10; in this embodiment, two rows of pressure generating chambers 12 are provided. In this embodiment, a portion between pressure generating chambers 12 arranged in the flow path forming substrate 10 in a row in the first direction X will be referred to as the partition wall 11. This partition wall 11 is formed along the second direction Y. That is, the partition wall 11 refers to a portion where the flow path forming substrate 10 overlaps the pressure generating chamber 12 in the second direction Y. The vibrating plate 50, which is a movable wall that defines one surface of each pressure generating chamber 12, is formed so as to extend across the partition walls 11, which separate the pressure generating chambers 12. When the vibrating plate 50, which defines one surface of each pressure generating chamber 12, is warped, a change occurs in the pressure of the ink in the pressure generating chamber 12.

A communicating plate 15 and nozzle plate 20 are laminated in succession on another surface of the flow path forming substrate 10 of this type.

Nozzle communicating paths 16, through each of which the pressure generating chamber 12 and nozzle 21 communicate with each other, are formed in the communicating plate 15 as illustrated in FIG. 4. The communicating plate 15 has a larger area than the flow path forming substrate 10, and the nozzle plate 20 has a smaller area than the flow path forming substrate 10. Since the nozzle plate 20 only needs to cover the openings of the nozzle communicating paths 16, through each of which the pressure generating chamber 12 and nozzle 21 communicate with each other, the area of the nozzle plate 20 can be made relatively small and costs can thereby be reduced. In this embodiment, a surface, of the nozzle plate 20, in which the nozzle 21 is open and from which ink droplets are discharged is referred to as a liquid ejection surface 20*a*.

The communicating plate 15 includes a first manifold portion 17 and a second manifold portion 18, each of which is part of a manifold 100. The manifold 100 is a common liquid chamber with which a plurality pressure generating chambers 12 communicate in common. In this embodiment, a separate manifold 100 is provided for each row of pressure generating chambers 12 arranged in a row in the first direction X. That is, two rows of pressure generating chambers 12, in each of which pressure generating chambers 12 are arranged in a row in the first direction X, are provided in the second direction Y, and manifolds 100 are placed on both sides of the two rows of pressure generating chambers 12 in the second direction Y, one on each side. One manifold 100 communicates with one row of pressure generating chambers 12, and the other manifold 100 communicates with the other row of pressure generating chambers 12.

Specifically, the first manifold portion 17, which is part of the manifold 100, is formed so as to pass through the communicating plate 15 in the third direction Z. The second manifold portion 18 is formed so as to be open in the communicating plate 15 on the same side as a nozzle plate 20 without passing through the communicating plate 15 in the third direction Z. The first manifold portion 17 and second manifold portion 18 are provided on both sides of the communicating plate 15 in the second direction Y.

In the communicating plate 15, one supply communicating path 19, which communicates with one end of the pressure generating chamber 12 in the second direction Y, is independently formed for each pressure generating chamber 12. The supply communicating path 19 communicates with the second manifold portion 18 and pressure generating chamber 12 to supply the ink in the manifold 100 to the pressure generating chamber 12.

Nozzles 21, each of which communicates with one pressure generating chamber 12 through the relevant nozzle communicating path 16, are formed in the nozzle plate 20. Since, in this embodiment, two rows of pressure generating chambers 12, in each of which pressure generating chambers 12 are arranged in a row in the first direction X, are formed in the second direction Y, two nozzle rows, each of which is composed of nozzles 21 arranged in a row in the first direction X, are also formed in the second direction Y.

Another point to note is that since pressure generating chambers 12 form a row arranged in the first direction X for each manifold 100 with which the pressure generating chambers 12 communicate in common as described above, each nozzle row communicates with a different manifold 100. In this embodiment, one nozzle row is referred to as the first nozzle row 21A and the other nozzle row is referred to as the second nozzle row 21B, as described above. The manifold 100, which is a common liquid chamber, differs between the first nozzle row 21A and the second nozzle row 21B. Thus, since the first nozzle row 21A and second nozzle row 21B communicate with different manifolds 100, different types of inks can be discharged. Of course, when the same type of ink is supplied to different manifolds 100, it is also possible to discharge the same type of ink from the first nozzle row 21A and second nozzle row 21B.

A metal such as stainless steel (SUS), organic matter such as a polyimide resin, or a monocrystalline silicon substrate, for example, can be used as the material of this nozzle plate 20.

On the surface, opposite to the communicating plate 15, of the flow path forming substrate 10, the vibrating plate 50 is formed as described above. A first electrode 60, a piezoelectric layer 70, and a second electrode 80 are formed, which and laminated on the vibrating plate 50 by a lithography method, constituting a piezoelectric actuator 300. In this embodiment, the piezoelectric actuator 300 is a pressure generation unit that causes a change in the pressure of the ink in the pressure generating chamber 12. The piezoelectric actuator 300, also referred to as the piezoelectric element, refers to a portion that includes the first electrode 60, piezoelectric layer 70, and second electrode 80. A portion that undergoes piezoelectric distortion in the piezoelectric layer 70 when a voltage is applied between the first electrode 60 and the second electrode 80 is referred to as an active portion 310. That is, the active portion 310 refers to a portion, of the piezoelectric layer 70, that is sandwiched between the first electrode 60 and the second electrode 80 in the third direction Z. In this embodiment, one active portion 310 is formed for each pressure generating chamber 12. In general, any one electrode of the piezoelectric actuator 300 is used as a common electrode, and the other electrode and piezoelectric layer 70 are patterned for each pressure generating chamber 12, that is, for each active portion 310. In this embodiment, the first electrode 60 is used as a common electrode for a plurality of active portions 310, and the second electrode 80 is used as an individual electrode for each active portion 310. However, even when for convenience for the driving circuit and wiring, the second electrode 80 is used as a common electrode for a plurality of active portions 310 and the first electrode 60 is used as an individual electrode for each active portion 310, no problem arises. Although, in the example described above, the vibrating plate 50 and first electrode 60 act as a vibrating plate, this is, of course, not a limitation. For example, only the first electrode 60 may act as a vibrating plate without the vibrating plate 50 being provided. Alternatively, the piezoelectric actuator 300 itself may double essentially as a vibrating plate.

The piezoelectric layer 70 is formed from an oxide piezoelectric material having a polarization structure formed on the first electrode 60. For example, the piezoelectric layer 70 can be formed from a perovskite-type oxide represented by a general formula $ABO_3$. A lead-based piezoelectric material including lead or non-lead-based piezoelectric material free from lead can be used as the material of the piezoelectric layer 70. The piezoelectric layer 70 can be formed by, for example, a liquid-phase method such as a sol-gel method or metal-organic decomposition (MOD) method or a physical vapor deposition (PVD) method (a type of vapor-phase method) such as a sputtering method or laser ablation method.

A lead electrode 90 is coupled to the second electrode 80 of each piezoelectric actuator 300 of this type. A voltage is selectively applied to each piezoelectric actuator 300 through the lead electrode 90.

A flexible cable 101 is coupled to the lead electrode 90 and first electrode 60. The flexible cable 101 is a flexible wiring board. In this embodiment, a driving circuit 102, which is a driving element, is mounted on the flexible cable 101.

A protective substrate 30, having substantially the same size as the flow path forming substrate 10, is joined to the surface of the flow path forming substrate 10 on the same side as the piezoelectric actuator 300. The protective substrate 30 has a holding section 31, which is space to protect the piezoelectric actuator 300. Two holding sections 31 are formed side by side in the second direction Y between the rows of piezoelectric actuators 300 arranged in rows in the first direction X. In the protective substrate 30, a through-hole 32 extending in the third direction Z is also formed between the two holding sections 31 arranged side by side in the second direction Y. The first electrode 60 and the lead electrode 90 led out of the electrodes of the piezoelectric actuator 300 extend so as to be exposed to this through-hole 32. The lead electrode 90 and first electrode 60 are electrically coupled to the flexible cable 101 in the through-hole 32.

As illustrated in FIG. 4, a case member 40 is fixed onto the protective substrate 30. The case member 40 defines the manifold 100 communicating with a plurality of pressure generating chambers 12, together with the flow path forming substrate 10. The case member 40, which has substantially the same shape as the communicating plate 15 described above in plan view, is joined to the protective substrate 30 and is also joined to the communicating plate 15 described above.

This case member 40 has a concave portion 41 deep enough to accommodate the flow path forming substrate 10 and protective substrate 30 on the same side as the protective substrate 30. The area of the opening of the concave portion 41 is wider than a surface, joined to the flow path forming substrate 10, of the protective substrate 30. The opening surface of the concave portion 41 on the same side as the nozzle plate 20 is sealed by the communicating plate 15 in a state in which the flow path forming substrate 10 and the like are accommodated in the concave portion 41. Thus, the case member 40 and flow path forming substrate 10 define a third manifold section 42 at the outer circumferential portion of the flow path forming substrate 10. The first manifold portion 17 and second manifold portion 18 provided on the communicating plate 15 and the third manifold section 42 defined by the case member 40 and flow path forming substrate 10 constitute the manifold 100 in this embodiment. The manifold 100 is continuously provided in the first direction X in which pressure generating chambers 12 are arranged in a row. Supply communicating paths 19, through each of which one pressure generating chamber 12 and the manifold 100 communicate with each other, are arranged in a row in the first direction X.

A compliance substrate 45 is provided on the surface, of the communicating plate 15, in which the first manifold portion 17 and second manifold portion 18 are open. This compliance substrate 45 seals the openings of the first manifold portion 17 and second manifold portion 18 on the same side as the liquid ejection surface 20*a*. The compliance substrate 45 of this type has a sealing film 46, which is a flexible thin film, and a fixed substrate 47 formed from a hard material such as a metal. The region, facing the manifold 100, of the fixed substrate 47 is a fixed substrate opening 48, which is completely eliminated in the thickness direction of the fixed substrate 47. Therefore, one surface of the manifold 100 is a compliance portion 49, which is a flexible portion sealed only by the flexible sealing film 46.

A cover head 130 is joined to the compliance substrate 45. Since, in this embodiment, an exposure opening 131 in the cover head 130 has an area slightly larger than the nozzle plate 20, the whole of the nozzle plate 20 is exposed through the exposure opening 131.

The case member 40 includes an introduction path 44, which communicates with the manifold 100 and through which an ink is supplied to the manifold 100. The case member 40 also includes a coupling port 43, which communicates with the through-hole 32 in the protective substrate 30 and through which the flexible cable 101 is passed.

With the recording head 1 of this type, when an ink is to be ejected, the ink is taken from the introduction path 44 and the interior of the flow path from the manifold 100 to the nozzle 21 is filled with the ink. After that, a voltage is applied to the piezoelectric actuator 300 corresponding to the pressure generating chamber 12 in response to a signal from the driving circuit 102 to warp the vibrating plate 50 together with the piezoelectric actuator 300. Thus, the pressure in the pressure generating chamber 12 is increased, causing ink droplets to be ejected from the corresponding nozzles 21.

Figure 6:
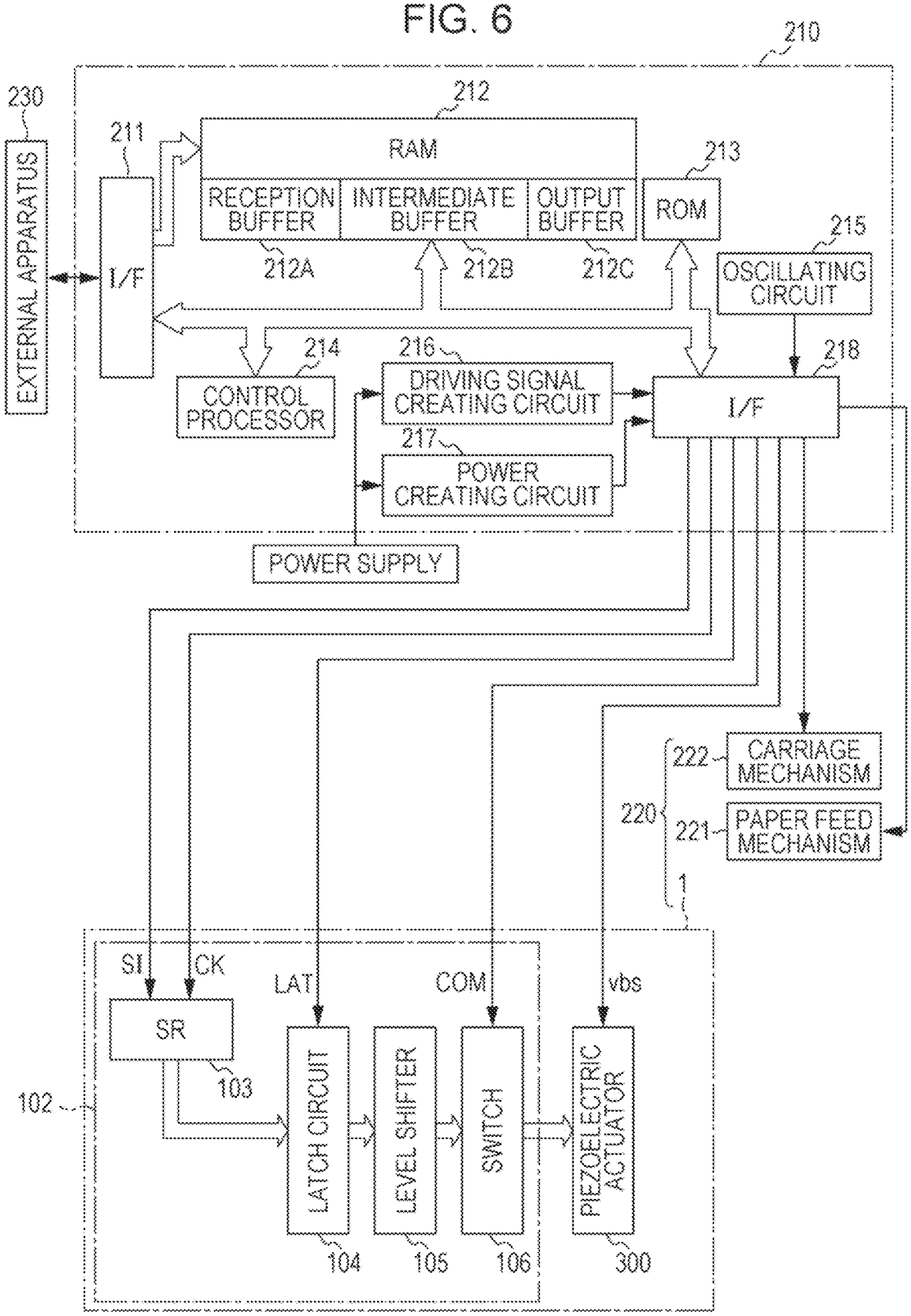
FIG. 6 is a block diagram illustrating the electrical structure of the recording apparatus according to the first embodiment.

The ink jet recording apparatus I has a control device 200 as illustrated in FIGS. 1 and 6. Now, an electric structure in this embodiment will be described with reference to FIG. 6.

FIG. 6 is a block diagram illustrating the electrical structure of the ink jet recording apparatus I according to the first embodiment.

As illustrated in FIG. 6, the ink jet recording apparatus I has a printer controller 210 and a print engine 220.

The printer controller 210 is an element that controls the whole of the ink jet recording apparatus I. In this embodiment, the printer controller 210 is disposed in the control device 200 provided in the ink jet recording apparatus I.

The printer controller 210 has an external interface 211 (referred to below as the external I/F 211), a random-access memory (RAM) 212 that temporarily stores various types of data, a read-only memory (ROM) 213 that stores control programs and the like, a control processor 214 that includes a central processing unit (CPU), an oscillating circuit 215 that generates a clock signal, a driving signal creating circuit 216 that generates a driving signal to be supplied to the recording head 1, a power creating circuit 217 that creates a bias voltage, and an internal interface 218 (referred to below as the internal I/F 218) that transmits, to the print engine 220, (i) a driving signal and (ii) dot pattern data (also referred to as bit map data) converted from print data.

The external I/F 211 receives print data that includes a character code, a graphic function, image data, and the like from an external apparatus 230 such as a host computer. A busy signal (BUSY) and an acknowledge signal (ACK) are output to the external apparatus 230 through this external I/F 211.

The RAM 212 functions as a reception buffer 212A, an intermediate buffer 212B, an output buffer 212C, and a work memory (not illustrated). The reception buffer 212A temporarily stores print data received by the external I/F 211. The intermediate buffer 212B stores intermediate code data resulting from conversion by the control processor 214. The output buffer 212C stores dot pattern data. The dot pattern data is formed from print data obtained by decoding (translating) gray-scale data.

Font data, graphic functions, and the like are also stored in the ROM 213 besides control programs (control routines) that process various types of data.

The control processor 214 reads out print data from the reception buffer 212A, converts the read-out print data to intermediate code data, and stores the intermediate code data in the intermediate buffer 212B. The control processor 214 also reads out intermediate code data from the intermediate buffer 212B, analyzes the read-out intermediate code data, and converts it to dot pattern data with reference the font data, graphic functions, and the like stored in the ROM 213. The control processor 214 then performs necessary ornament processing, after which the control processor 214 stores the converted dot pattern data in the output buffer 212C.

When dot pattern data for one line is obtained in the output buffer 212C, the dot pattern data for this one line is output to the recording head 1 through the internal I/F 218. After the dot pattern data for the one line has been output from the output buffer 212C, the intermediate code data converted to the dot pattern data is deleted from the intermediate buffer 212B and conversion processing is performed on next intermediate code data.

The driving signal creating circuit 216 creates a driving signal COM according to power supplied from the outside.

The power creating circuit 217 also creates a bias voltage vbs to be supplied to the first electrode 60, which is common to piezoelectric actuators 300, according to the power supplied from the outside.

The print engine 220 includes the recording head 1, a paper feed mechanism 221, and a carriage mechanism 222. The paper feed mechanism 221 includes a transport roller, a motor that drives the transport roller, and the like. The paper feed mechanism 221 feeds out recording sheets S in succession in synchronization with the recording operation of the recording head 1. That is, the paper feed mechanism 221 relatively moves the recording sheet S in the first direction X. The carriage mechanism 222 has the carriage 5, the carriage motor 7 that moves the carriage 5 in the second direction Y along the guide shaft 4, and the timing belt 6.

The recording head 1 has the piezoelectric actuator 300 as well as the driving circuit 102 that includes a shift register 103, a latch circuit 104, a level shifter 105, and a switch 106. Although not illustrated, the shift register 103, latch circuit 104, level shifter 105, switch 106, and piezoelectric actuator 300 are respectively a shift register element, a latch element, a level shifter element, a switch element, and piezoelectric actuator 300 provided for each nozzle 21 in the recording head 1. The shift register 103, latch circuit 104, level shifter 105, switch 106, and piezoelectric actuator 300 are coupled in that order. The shift register 103, latch circuit 104, level shifter 105, and switch 106 create a pulse to be applied from a driving signal created by the driving signal creating circuit 216. The pulse to be applied is a pulse that is actually applied to the piezoelectric actuator 300.

In this embodiment, the printer controller 210 and driving circuit 102 are equivalent to a controller in the scope of the claims.

Figure 7:
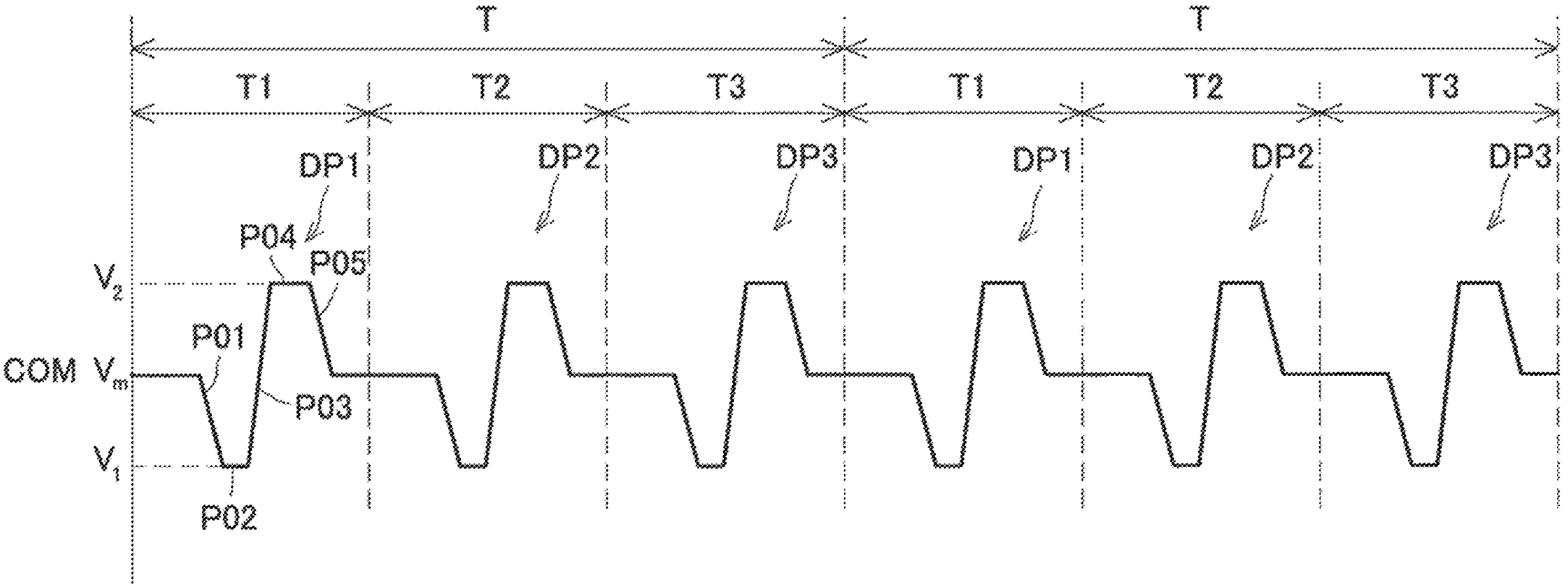
FIG. 7 illustrates a driving waveform indicating a driving signal according to the first embodiment.

Now, a driving waveform indicating the driving signal (COM) generated by the driving signal creating circuit 216 will be described. FIG. 7 illustrates a driving waveform indicating the driving signal COM.

As illustrated in FIG. 7, the driving signal COM in this embodiment is repeatedly created from the driving signal creating circuit 216 at intervals of a recording cycle T. The recording cycle T, also referred to as the discharging cycle T, corresponds to one pixel of an image or the like to be printed on the recording sheet S. In this embodiment the discharging cycle T is divided into three periods, T1, T2 and T3. A first discharging pulse DP1, a second discharging pulse DP2, and a third discharging pulse DP3, which cause ink droplets to be discharged, are respectively created in the periods T1, T2, and T3 in the discharging cycle T. That is, in the period T1 in the discharging cycle T, the first discharging pulse DP1 is created that drives the piezoelectric actuator 300 so that ink droplets are discharged from the nozzle 21; in the period T2 in the discharging cycle T, the second discharging pulse DP2 is created that drives the piezoelectric actuator 300 so that ink droplets are discharged from the nozzle 21; and in the period T3 in the discharging cycle T, the third discharging pulse DP3 is created that drives the piezoelectric actuator 300 so that ink droplets are discharged from the nozzle 21.

When a dot pattern for one line (for one luster) is to be formed in a recording region on the recording sheet S during printing, the first discharging pulse DP1, second discharging pulse DP2, or third discharging pulse DP3 of the driving signal COM is selectively applied to the piezoelectric actuator 300 corresponding to each nozzle 21. That is, a pulse to be applied is created from a head control signal and the driving signal COM for each piezoelectric actuator 300 corresponding to each nozzle 21, and the pulse is applied to the piezoelectric actuator 300. This pulse to be applied is supplied to the second electrode 80, which is an individual electrode for the active portion of each piezoelectric actuator 300. A bias voltage (vbs) is supplied to the first electrode 60, which is common to the active portions of a plurality of piezoelectric actuators 300. Therefore, a voltage applied to the second electrode 80, which is the individual electrode of the piezoelectric actuator 300, is represented with reference to the vias voltage (vbs) applied to the first electrode 60.

The first discharging pulse DP1 includes a first expansion element P01 applied from an intermediate potential Vm to a first potential $V_1$ to expand the volume of the pressure generating chamber 12 from a reference volume, a first expansion maintaining element P02 that maintains the volume of the pressure generating chamber 12 that has been expanded by the first expansion element P01 for a certain period of time, a first contraction element P03 applied from the first potential $V_1$ to a second potential $V_2$ to contract the volume of the pressure generating chamber 12, a first contraction maintaining element P04 that maintains the volume of the pressure generating chamber 12 that has been contracted by the first contraction element P03 for a certain period of time, and a first restoration element P05 that restores the pressure generating chamber 12 in the contraction state at the second potential $V_2$ to the reference volume at the intermediate potential Vm.

When this first discharging pulse DP1 is supplied to the piezoelectric actuator 300, the piezoelectric actuator 300 is deformed so that the volume of the pressure generating chamber 12 is expanded by the first expansion element P01. Then, meniscuses in the nozzle 21 are drawn toward the pressure generating chamber 12 and an ink is supplied from the manifold 100 into the pressure generating chamber 12. The expanded state of the pressure generating chamber 12 is maintained by the first expansion maintaining element P02. After that, the first contraction element P03 is supplied, causing the pressure generating chamber 12 to rapidly contract from the expanded volume to the contracted volume corresponding to the second potential $V_2$. Accordingly, the ink in the pressure generating chamber 12 is pressurized, and ink droplets are discharged from the nozzle 21. The contracted state of the pressure generating chamber 12 is maintained by the first contraction maintaining element P04. While the contracted state is being maintained, the ink pressure in the pressure generating chamber 12, which has been reduced as a result of the discharging of ink droplets, is raised again due to the natural vibration of the ink. The first restoration element P05 is supplied when the ink pressure starts to rise, causing the pressure generating chamber 12 to be restored to the reference volume. Accordingly, variations in the pressure in the pressure generating chamber 12 are eliminated.

In this embodiment, the second discharging pulse DP2 and third discharging pulse DP3 have the same driving waveform as the first discharging pulse DP1. Of course, the first discharging pulse DP1, second discharging pulse DP2, and third discharging pulse DP3 may have the same driving waveform or may have different driving waveforms.

The driving signal COM described above is selectively supplied to the piezoelectric actuator 300 corresponding to the nozzle 21 from which ink droplets are to be discharged for each discharging cycle T, according to print data (SI) constituting dot pattern data, so ink droplets are discharged. During printing, the driving signal COM is not supplied to the piezoelectric actuator 300 corresponding to the nozzle 21 from which ink droplets are not intended to be discharged, but the piezoelectric actuator 300 has the immediately previous potential. Therefore, piezoelectric actuator 300 maintains the immediately previous displacement state, that is, the intermediate potential Vm.

When, for example, small dots (S dots) are to be recorded by using the driving signal COM, only the first discharging pulse DP1 generated in the period T1 of the driving signal COM in one discharging cycle T is supplied to the piezoelectric actuator 300.

When middle dots (M dots) are to be recorded, the first discharging pulse DP1 generated in the period T1 of the driving signal COM in one discharging cycle T and the second discharging pulse DP2 generated in the period T2 are supplied to the piezoelectric actuator 300. The third discharging pulse DP3 generated in the period T3 may be supplied to the piezoelectric actuator 300 instead of the second discharging pulse DP2 generated in the period T2.

When large dots (L dots) are to be recorded, the first discharging pulse DP1 generated in the period T1 of the driving signal COM in one discharging cycle T, the second discharging pulse DP2 generated in the period T2, and the third discharging pulse DP3 generated in the period T3 are supplied to the piezoelectric actuator 300. When dots are not to be formed, that is, ink droplets are not to be discharged, any of the first discharging pulse DP1, second discharging pulse DP2, and third discharging pulse DP3 is not supplied but the intermediate potential Vm is maintained. In this embodiment, although not illustrated, a micro-vibration pulse, which causes meniscuses in the nozzle 21 to be subject to micro-vibration, may be supplied to the piezoelectric actuator 300 for which ink droplets are not intended to be discharged, to the extent that ink droplets are not discharged.

The control device 200 causes the recording head 1 to perform preliminary discharging. Specifically, the control device 200 moves the recording head 1 to the home position region of the carriage 5, and causes the recording head 1 to perform preliminary discharging in which ink droplets are discharged from the first nozzle row 21A and second nozzle row 21B in the recording head 1 toward the cap 9*a* as illustrated in FIG. 2. An absorbing body 9*b* formed from a porous material or the like is provided in the cap 9*a*. When the cap 9*a* covers the first nozzle row 21A and second nozzle row 21B with an ink held in the absorbing body 9*b*, the interior of the cap 9*a* is moistened. In this embodiment, the control device 200 executes the first preliminary discharging mode and second preliminary discharging mode as preliminary discharging. In preliminary discharging in the first preliminary discharging mode, ink droplets are discharged into the cap 9*a* to moisten the interior of the cap 9*a*. In this mode, therefore, a large amount of ink needs to be discharged into the cap 9*a* in a relatively short time. In contrast to this, preliminary discharging in the second preliminary discharging mode is intended to be periodically executed, for example, before or during printing to restrain ink in the vicinity of the nozzle 21 from becoming viscous so that discharging failures of ink droplets is suppressed. Now, the number of times ink droplets are discharged in the first preliminary discharging mode will be referred to as a first discharging count and the number of times ink droplets are discharged in the second preliminary discharging mode will be referred to as a second discharging count. Then, the second discharging count is smaller than the first discharging count (first discharging count>second discharging count). In this embodiment, the number of times ink droplets are discharged in the first preliminary discharging mode is, for example, 600,000 shots per nozzle, and the number of times ink droplets are discharged in the second preliminary discharging mode is, for example, 108 shots per nozzle.

Figure 8:
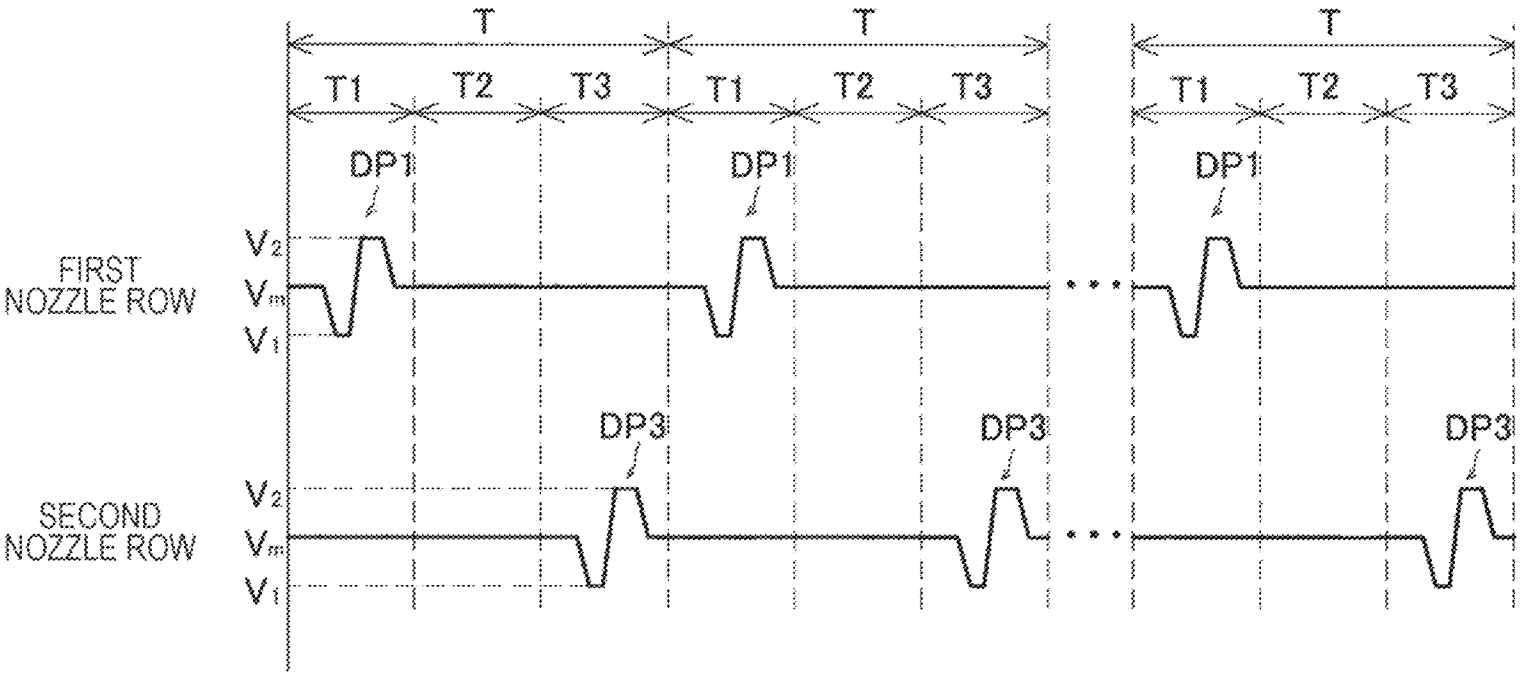
FIG. 8 illustrates driving waveforms in a first preliminary discharging mode according to the first embodiment.

Now, the first preliminary discharging mode in this embodiment will be described with reference to FIG. 8. FIG.

8 illustrates driving waveforms indicating the first preliminary discharging mode. In preliminary discharging in the first preliminary discharging mode performed by the control device 200 in this embodiment, only the first discharging pulse DP1 is selected and is applied to the piezoelectric actuators 300 corresponding to the first nozzle row 21A in the discharging cycle T, as illustrated in FIG. 8. This pulse to be applied in which only the first discharging pulse DP1 is selected is supplied to the piezoelectric actuators 300 corresponding to the first nozzle row 21A for each discharging cycle T. That is, in the first nozzle row 21A, concurrent discharging and concurrent non-discharging from all nozzles 21 are intermittently performed. In concurrent discharging, ink droplets are discharged from all nozzles 21 constituting the first nozzle row 21A at the same time. In this embodiment, the first discharging pulse DP1 is applied to the piezoelectric actuators 300 corresponding to all nozzles 21 constituting the first nozzle row 21A in the period T1 of the discharging cycle T to have ink droplets discharged from all nozzles 21 at the same time. In concurrent non-discharging, ink droplets are not discharged from any nozzles 21 included in the first nozzle row 21A in the period T1.

In intermittent concurrent discharging in the first nozzle row 21A, concurrent non-discharging is performed between concurrent discharging and next concurrent discharging. In this embodiment, concurrent discharging is performed after an interval of a certain period, which is at least one of the periods T1 to T3. In intermittent concurrent non-discharging, concurrent discharging is performed between concurrent non-discharging and next concurrent non-discharging. In this embodiment, concurrent non-discharging is performed after an interval of a certain period, which is at least one of the periods T1 to T3.

Since, in the first nozzle row 21A in this embodiment, the discharging cycle T is repeated in which concurrent discharging is performed in the period T1 and concurrent non-discharging is performed in the periods T2 and T3, it can be said that concurrent discharging and concurrent non-discharging are intermittently performed.

In the same discharging cycle T as in the first nozzle row 21A, only the third discharging pulse DP3 is selected and applied to the piezoelectric actuators 300 corresponding to the second nozzle row 21B. A pulse to be applied in which only the third discharging pulse DP3 is selected in this way is supplied to the piezoelectric actuators 300 corresponding to the second nozzle row 21B in each discharging cycle T. That is, in the second nozzle row 21B, concurrent discharging and concurrent non-discharging from all nozzles 21 are intermittently performed.

In the period T1 in which concurrent discharging is performed from the nozzles 21 in the first nozzle row 21A, concurrent non-discharging is performed in which ink droplets are not discharged from the nozzles 21 in the second nozzle row 21B. In the period T3 in which concurrent discharging is performed from the nozzles 21 in the second nozzle row 21B, concurrent non-discharging is performed in which ink droplets are not discharged from the nozzles 21 in the first nozzle row 21A. That is, concurrent discharging is performed from the nozzles 21 in the first nozzle row 21A after a certain period of time, and concurrent discharging is performed from the nozzles 21 in the second nozzle row 21B while concurrent discharging from the nozzles 21 in the first nozzle row 21A is stopping. Concurrent discharging is also performed from the nozzles 21 in the second nozzle row 21B after a certain period of time, and concurrent discharging is performed from the nozzles 21 in the first nozzle row 21A while concurrent discharging from the nozzles 21 in the second nozzle row 21B is stopping. That is, in the period T1 in which ink droplets are discharged from the first nozzle row 21A, ink droplets are not discharged from the second nozzle row 21B, and in the period T3 in which ink droplets are discharged from the second nozzle row 21B, ink droplets are not discharged from the first nozzle row 21A, so the first nozzle row 21A and second nozzle row 21B mutually complement timings at which to discharge ink droplets.

When concurrent discharging of ink droplets is performed from the nozzles 21 in the first nozzle row 21A as described above, it is possible to suppress the generation of mist due to the generation of a self jet flow resulting from the successive discharging of ink droplets and to suppress the adhesion of mist to the nozzle plate 20. In particular, when one cap 9*a* is provided separately for each head chip 110 as in this embodiment, mist is likely to be generated due to a self jet flow of ink droplets because the area of the cap 9*a* is small and ink is thereby discharged into the cap 9*a* with the carriage 5 stopped. In this embodiment, however, concurrent discharging of ink droplets is intermittently performed, so it is possible to suppress the generation of mist even when one cap 9*a* is provided separately for each head chip 110.

In the first preliminary discharging mode in this embodiment, concurrent discharging, in which ink droplets are discharged from all nozzles 21 constituting the first nozzle row 21A or second nozzle row 21B at the same time, and concurrent non-discharging from these nozzles are performed. Therefore, it is possible to cause a pressure change in the interiors of mutually adjacent pressure generating chambers 12 communicating with nozzles 21 included in a nozzle row and thereby to restrain a pressure change in the ink in the pressure generating chamber 12 from being eliminated by the deformation of the partition wall 11. This can suppress a drop in the flying speed of ink droplets. Another point to note is that when the flying speed of ink droplets drops, more mist is generated. When concurrent discharging from all nozzles 21 in a nozzle row or concurrent non-discharging from these nozzles are performed, therefore, it is possible to suppress a drop in the flying speed of ink droplets and to reduce the amount of mist adhering to the liquid ejection surface.

Pressure generating chambers 12 communicating with the nozzles 21 constituting a nozzle row communicate with the manifold 100, which is a common liquid chamber with which these pressure generating chambers 12 communicate. Therefore, when discharging and non-discharging are repeated in short cycles at mutually close nozzles 21 constituting a nozzle row, the effect of variations in pressure occurs through the manifold 100 and ink droplets are thereby likely to be discharged unstably. This may cause problems in that, for example, mist is generated, and bubbles are taken from nozzles 21. However, since, in the first preliminary discharging mode in this embodiment, concurrent discharging, in which ink droplets are discharged from all nozzles 21 constituting the first nozzle row 21A or second nozzle row 21B at the same time, and concurrent non-discharging, in which ink droplets are not discharged from these nozzles, are performed, the effect of variations in pressure through the manifold 100 is not easily caused. This makes it possible to stably discharge ink droplets and to reduce the amount of generated mist. It is also possible to restrain bubbles from being taken from the nozzle 21.

Since the first nozzle row 21A and second nozzle row 21B mutually complement timings at which to discharge ink droplets, ink droplets are not discharged from the nozzles 21 in the first nozzle row 21A and the nozzles 21 in the second nozzle row 21B at the same timing. Therefore, the number of nozzles 21, in the first nozzle row 21A and second nozzle row 21B, from which ink droplets are discharged at the same time can be reduced, making it possible to suppress the generation of mist. In particular, since the first nozzle row 21A and second nozzle row 21B are disposed in the same head chip 110, they are placed close to each other and discharge ink droplets into the same cap 9*a*. Therefore, when the number of nozzles 21, in the first nozzle row 21A and second nozzle row 21B, from which ink droplets are discharged at the same time is reduced, the generation of mist can be efficiently suppressed.

Since, in this embodiment, the first nozzle row 21A and second nozzle row 21B mutually complement timings at which to discharge ink droplets, as described above, even when ink droplets are intermittently discharged from the nozzles 21 in the first nozzle row 21A and second nozzle row 21B, it is possible to restrain a time needed for preliminary discharging in the first preliminary discharging mode from being greatly prolonged.

Figure 9:
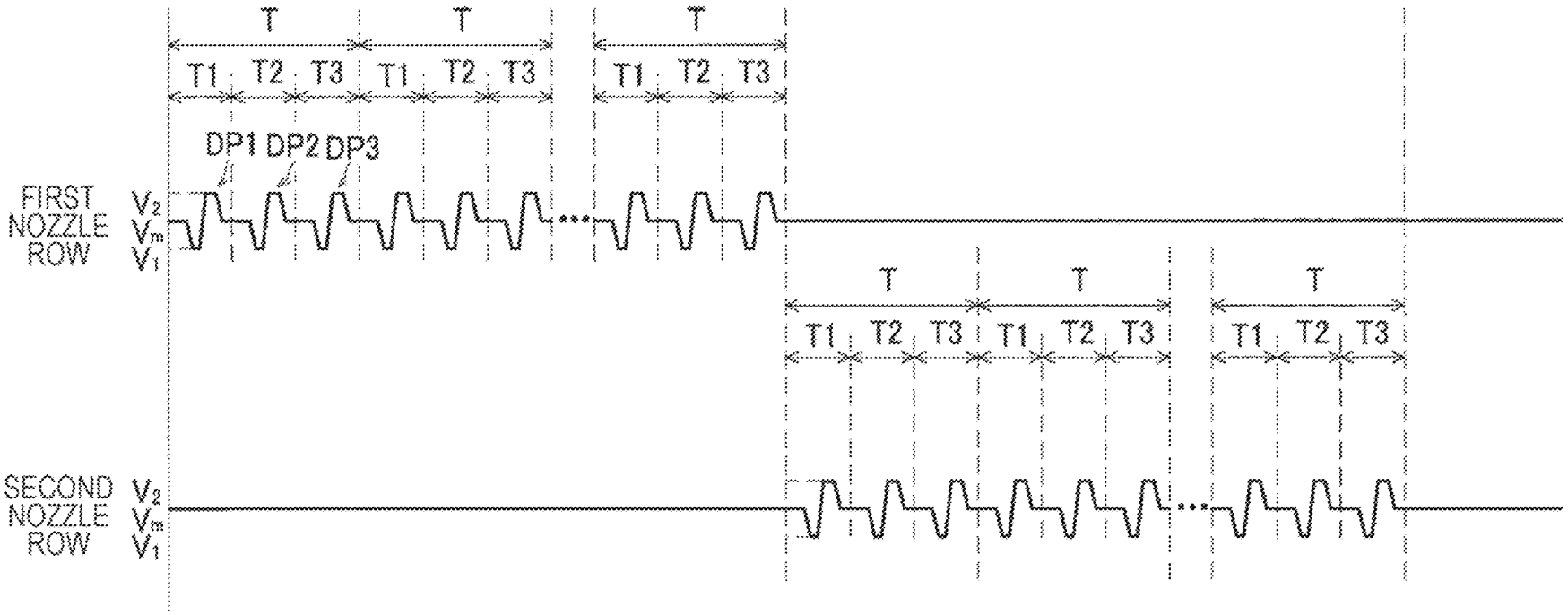
FIG. 9 illustrates driving waveforms in a second preliminary discharging mode according to the first embodiment.

The second preliminary discharging mode will also be described with reference to FIG. 9. FIG. 9 illustrates driving waveforms indicating the second preliminary discharging mode.

In the second preliminary discharging mode, the first discharging pulse DP1, second discharging pulse DP2, and third discharging pulse DP3 are all selected to have an ink droplet discharged three times from the first nozzle row 21A in the discharging cycle T, as illustrated in FIG. 9. This discharging of ink droplets is performed in succession over a certain period composed of consecutive discharging periods T. That is, concurrent discharging from the first nozzle row 21A is not intermittently performed but is performed in succession. In the discharging of ink droplets from the first nozzle row 21A, a pulse to be applied illustrated in FIG. 9 is supplied to the piezoelectric actuators 300 corresponding to all nozzles 21 constituting the first nozzle row 21A and ink droplets are discharged from all the nozzles 21 constituting the first nozzle row 21A at the same time.

In the second preliminary discharging mode in this embodiment, ink droplets are discharged from the first nozzle row 21A at the same time in the discharging cycle T, as described above. In the second preliminary discharging mode, however, ink droplets are not discharged from the second nozzle row 21B in the discharging cycle T. That is, concurrent non-discharging is performed from the second nozzle row 21B in succession. After concurrent discharging of ink droplets is performed from the first nozzle row 21A in succession, that is, after concurrent non-discharging from the second nozzle row 21B is performed in succession, the first discharging pulse DP1, second discharging pulse DP2, and third discharging pulse DP3 are all selected to have an ink droplet discharged three times from the second nozzle row 21B in the discharging cycle T. This discharging of ink droplets is performed in succession over a certain period composed of consecutive discharging periods T. That is, concurrent discharging from the second nozzle row 21B is not intermittently performed but is performed in succession. In the discharging of ink droplets from the second nozzle row 21B, a pulse to be applied illustrated in FIG. 9 is supplied to the piezoelectric actuators 300 corresponding to all nozzles 21 constituting the second nozzle row 21B and ink droplets are discharged from all the nozzles 21 constituting the second nozzle row 21B at the same time. While concurrent discharging is being performed from the second nozzle row 21B, ink droplets are not discharged from the first nozzle row 21A but concurrent non-discharging is performed from the first nozzle row 21A in succession. In addition, in the second preliminary discharging mode in this embodiment, after concurrent discharging of ink droplets is performed in succession from the first nozzle row 21A over a certain period and then concurrent non-discharging is performed in succession from the first nozzle row 21A over a certain period, concurrent discharging of ink droplets from the first nozzle row 21A is not performed. Therefore, it is not said that concurrent discharging of ink droplets is intermittently performed from the first nozzle row 21A. Similarly, after concurrent discharging of ink droplets is performed in succession from the second nozzle row 21B over a certain period and then concurrent non-discharging is performed in succession from the second nozzle row 21B over a certain period, concurrent discharging of ink droplets from the second nozzle row 21B is not performed. Therefore, it is not said that concurrent discharging of ink droplets is intermittently performed from the second nozzle row 21B. Another point to note for the second nozzle row 21B is that after concurrent non-discharging of ink droplets is performed, concurrent discharging of ink droplets and concurrent non-discharging of ink droplets are performed in that order, it can be said that concurrent non-discharging is intermittently performed. From the second nozzle row 21B, however, both concurrent discharging and concurrent non-discharging are intermittently performed.

In the second preliminary discharging mode in this embodiment, concurrent discharging of ink droplets is performed from the first nozzle row 21A in all of the periods T1 to T3. In preliminary discharging in the first preliminary discharging mode, however, concurrent discharging of ink droplets is performed from the first nozzle row 21A only in the period T1. Therefore, a discharging frequency in the first nozzle row 21A per unit time in the second preliminary discharging mode is higher than a discharging frequency in the first nozzle row 21A per unit time in the first preliminary discharging mode. This is also true for the second nozzle row 21B. In the second preliminary discharging mode, concurrent discharging of ink droplets is performed in all of the periods T1 to T3. In the first preliminary discharging mode, however, concurrent discharging of ink droplets is performed from only in the period T3. Therefore, a discharging frequency in the second nozzle row 21B per unit time in the second preliminary discharging mode is higher than a discharging frequency in the second nozzle row 21B per unit time in the first preliminary discharging mode.

The second preliminary discharging mode described above, in which ink droplets are discharged in succession rather than intermittently and the discharging frequency per unit time in the nozzle row is higher than in the first preliminary discharging mode, is practicable because the discharging count is higher in the second preliminary discharging mode than in the first preliminary discharging mode. That is, since, in the second preliminary discharging mode, the discharging count of ink droplets is smaller than in the first preliminary discharging mode, the absolute amount of discharged ink is small, and mist is thereby less likely to be generated. Therefore, even when ink droplets are discharged in the second preliminary discharging mode, that is, in a discharging method in which only a short time is taken and the effect of restraining viscosity from being increased is high, that is, the discharging frequency per unit time in the nozzle row is high, when compared with the first preliminary discharging mode, it is possible to suppress the generation of mist and the adhesion of mist to the liquid ejection surface.

Although, in the second preliminary discharging mode in this embodiment, concurrent non-discharging in which concurrent discharging of ink droplets from the second nozzle row 21B is not performed has been performed at a timing at which concurrent discharging of ink droplets from the first nozzle row 21A is performed, this is not a limitation. As the second preliminary discharging mode, concurrent discharging of ink droplets may be performed from the first nozzle row 21A and second nozzle row 21B at the same timing.

Figure 10:
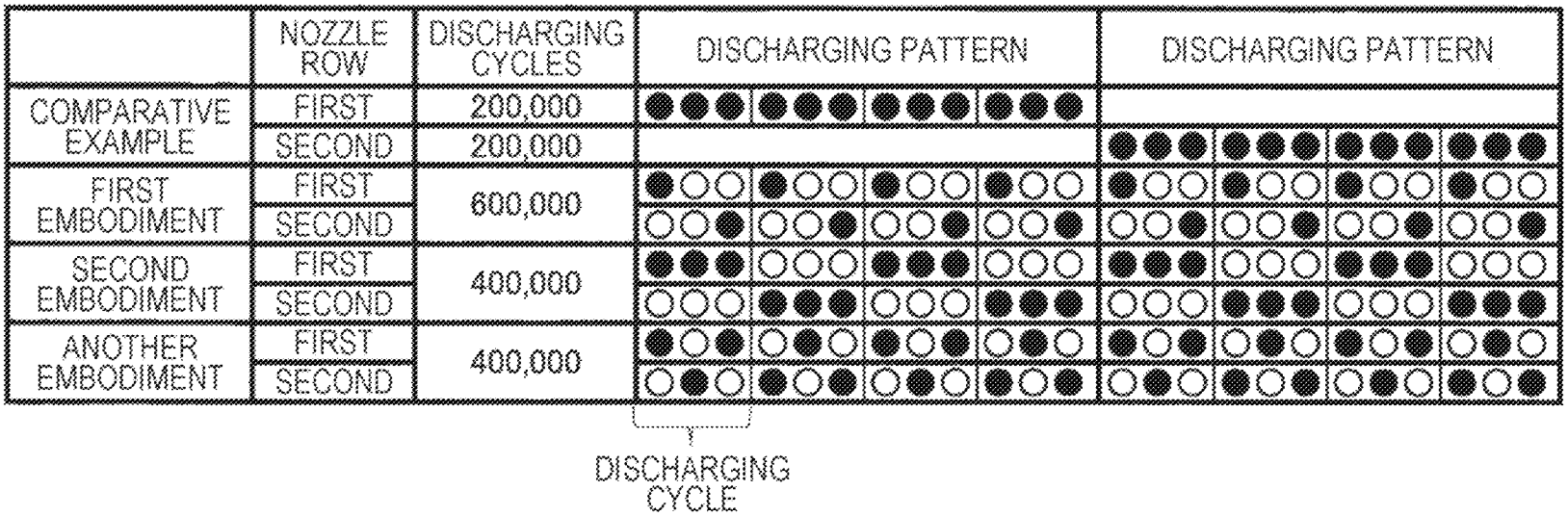
FIG. 10 is a table indicating discharging patterns in different embodiments.

Here, as a comparative example, concurrent discharging of ink droplets is performed from the nozzles 21 in the first nozzle row 21A in succession in 200,000 discharging cycles, and concurrent discharging of ink droplets is performed from the nozzles 21 in the second nozzle row 21B in succession in 200,000 discharging cycles, as illustrated in FIG. 10. In the first preliminary discharging mode in this embodiment, to discharge the same amount of ink as in the comparative example from the first nozzle row 21A and second nozzle row 21B, three times as many discharging cycles as in the comparative example are needed for each of the first nozzle row 21A and second nozzle row 21B. Specifically, although a total number of discharging cycles in the comparative example is 400,000, a total of six times as many discharging cycles as in the comparative example, that is, 1,200,000 discharging cycles, are needed for both the first nozzle row 21A and the second nozzle row 21B. In this embodiment, however, since the first nozzle row 21A and second nozzle row 21B mutually complement timings at which to discharge ink droplets, it is possible to perform, in one discharging cycle T, ink droplet discharging from the first nozzle row 21A once and ink droplet discharging from the second nozzle row 21B once. Therefore, a total number of discharging cycles in which ink droplets are discharged from the first nozzle row 21A and second nozzle row 21B can be reduced by half. That is, the same amount of ink droplets as in the comparative example can be discharged into the cap 9*a* in 600,000 discharging cycles.

When concurrent discharging is intermittently performed from the first nozzle row 21A and second nozzle row 21B as described above, mist can be reduced. In addition, since the first nozzle row 21A and second nozzle row 21B mutually complement timings at which to discharge ink droplets, even when the generation of mist is suppressed by reducing the frequency of ink droplet discharging, preliminary discharging can be executed in 600,000 discharging cycles, which is relatively short, without having to outstandingly prolong a time needed for preliminary discharging to, for example, 1,200,000 discharging cycles. Accordingly, a time needed for the first preliminary discharging mode can be shortened. This can suppress the drying of the ink in the cap 9*a* and a prolonged downtime to the execution of the next printing, which are caused when a time needed for preliminary discharging is long.

The ink jet recording apparatus I, which is the liquid ejecting apparatus in this embodiment, has: the ink jet recording head 1, which is a liquid ejecting head having a plurality of nozzle rows, which are, in this embodiment, the first nozzle row 21A and second nozzle row 21B, and in each of which nozzles 21 discharging an ink, which is a type of liquid, are arranged in a line; the piezoelectric actuators 300, each of which is a pressure generating unit that causes a change in pressure in the relevant pressure generating chamber 12, which is a flow path communicating with the relevant nozzle 21 to discharge the ink from the nozzle 21; the caps 9*a*, each of which covers the first nozzle row 21A and second nozzle row 21B; and a controller that controls the driving of the piezoelectric actuators 300 to eject inks from the nozzles 21. The controller carries out preliminary discharging in which inks are discharged from the first nozzle row 21A and second nozzle row 21B toward the cap 9*a*. The controller also controls the first preliminary discharging mode so as to be executable so that, in preliminary discharging from the first nozzle row 21A and second nozzle row 21B constituting the plurality of nozzle rows in the first preliminary discharging mode, the controller intermittently carries out concurrent discharging and concurrent non-discharging from the nozzles 21 in the first nozzle row 21A and second nozzle row 21B in such a way that when concurrent discharging is performed from the nozzles 21 in the first nozzle row 21A, concurrent non-discharging from the nozzles 21 in the second nozzle row 21B is performed, and when concurrent discharging is performed from the nozzles 21 in the second nozzle row 21B, concurrent non-discharging from the nozzles 21 in the first nozzle row 21A is performed.

When ink droplets are intermittently discharged from the nozzles 21 in each of the first nozzle row 21A and second nozzle row 21B as described above, it is possible to restrain ink droplets from being discharged from the same nozzle 21 in succession in a short time and thereby to suppress the generation of mist. In addition, when the discharging of ink droplets from the first nozzle row 21A and second nozzle row 21B at the same timing is prevented, the number of nozzles 21 from which ink droplets are discharged at the same time can be reduced and the generation of mist can thereby be suppressed. Furthermore, when concurrent non-discharging from the second nozzle row 21B is enabled during concurrent discharging from the first nozzle row 21A and concurrent non-discharging from the first nozzle row 21A is enabled during concurrent discharging from the second nozzle row 21B, it is possible to restrain a time needed for preliminary discharging from being outstandingly prolonged. This can suppress the drying of the ink in the cap 9*a* and a prolonged downtime to the execution of the next printing, which are caused when a time needed for preliminary discharging is long.

With the ink jet recording apparatus I in this embodiment, one pressure generating chamber 12 is preferably provided for each nozzle 21 in the first nozzle row 21A and second nozzle row 21B, each of which is a nozzle row, so as to communicate with the nozzle 21. A plurality of pressure generating chambers 12 communicating with the first nozzle row 21A and second nozzle row 21B preferably communicate with the manifolds 100 in common, each of which is a common liquid chamber. A manifold 100 corresponding to the first nozzle row 21A and a manifold 100 corresponding to the second nozzle row 21B preferably differ from each other. According to this, when concurrent discharging and concurrent non-discharging are performed from each nozzle row communicating with the manifold 100 common to the nozzles in the nozzle row, the effect of variations in pressure through the manifold 100, which is the effect of so-called crosstalk, is not easily caused. This makes it possible to stably discharge ink droplets and to reduce the amount of generated mist. It is also possible to restrain bubbles from being taken from the nozzle 21.

With the ink jet recording apparatus I in this embodiment, the ink jet recording head 1, which is a liquid ejecting head, preferably has pressure generating chambers 12 communicating with the nozzles 21 in the first nozzle row 21A and second nozzle row 21B, each of which is a nozzle row, partition walls 11 that separate the pressure generating chambers 12, and the vibrating plate 50, which is a movable wall passing over the partition walls 11, the vibrating plate 50 causing a pressure change in an ink, which is the liquid in the pressure generating chamber 12. According to this, even in the structure in which the partition walls 11 and the vibrating plate 50, which is a movable wall, are provided, when concurrent discharging is performed, a pressure change can be caused in adjacent pressure generating chambers 12 at the same time. This makes it possible to restrain a pressure change in the ink in the pressure generating chamber 12 from being eliminated due to the deformation of the partition wall 11 and to suppress a drop in the flying speed of ink droplets.

With the ink jet recording apparatus I in this embodiment, the controller further preferably controls the second preliminary discharging mode, in which preliminary discharging is performed with the second discharging count, which is smaller than the first discharging count in the first preliminary discharging mode, so as to be executable. In the second preliminary discharging mode, discharging from the first nozzle row 21A with the second discharging count and discharging from the second nozzle row 21B with the second discharging count are preferably performed concurrently. Alternatively, after discharging from the first nozzle row 21A with the second discharging count, discharging from the second nozzle row 21B is preferably performed with the second discharging count. According to this, since in the second preliminary discharging mode, the discharging count is smaller than in the first preliminary discharging mode, it is possible to perform preliminary discharging in a short time with a high effect of restraining viscosity from being increased. That is, in the second preliminary discharging mode, it is possible, for example, to perform preliminary discharging based on the driving waveforms illustrated in FIG. 9 and to execute the method of discharge ink droplets from the first nozzle row 21A and second nozzle row 21B at the same time. Even when in the second preliminary discharging mode, preliminary discharging is performed in a short time with a high effect of restraining viscosity from being increased, it is possible to suppress the adhesion of mist to the liquid ejection surface because in the second preliminary discharging mode, the discharging count is smaller than in the first preliminary discharging mode and the amount of ink droplets discharged is thereby smaller than in the first preliminary discharging mode.

With the ink jet recording apparatus I in this embodiment, the discharging frequency in the first nozzle row 21A and second nozzle row 21B, each of which is a nozzle row, per unit time in the second preliminary discharging mode is preferably higher than the discharging frequency in the first nozzle row 21A and second nozzle row 21B, each of which is a nozzle row, per unit time in the first preliminary discharging mode. According to this, since the second discharging count in the second preliminary discharging mode is smaller than the first discharging count in the first preliminary discharging mode, even when the discharging frequency per unit time is high, the amount of generated mist itself is small and mist does not thereby easily adhere to the nozzle plate 20.

Second Embodiment

Figure 11:
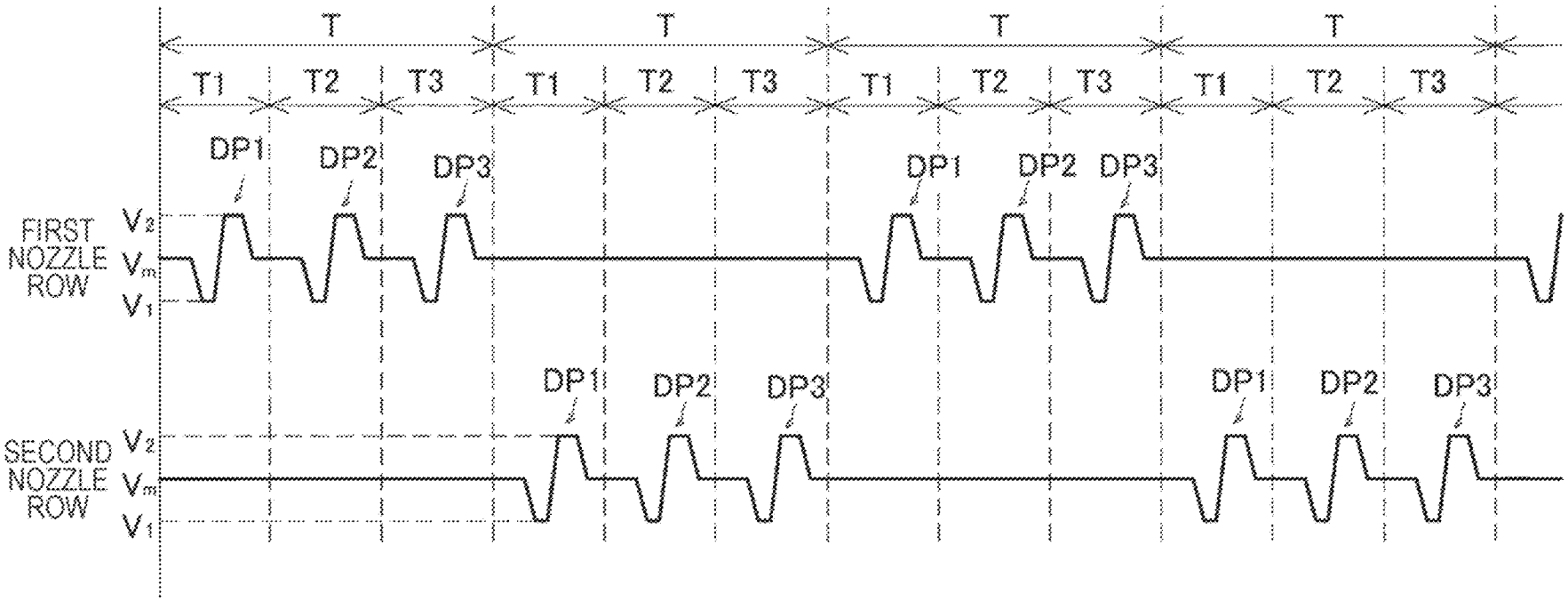
FIG. 11 illustrates driving waveforms indicating pulses to be applied in second preliminary discharging according to a second embodiment.

FIG. 11 illustrates driving waveforms indicating driving signals from a controller according to a second embodiment of the present disclosure. Members similar to members described above will be denoted by like reference characters, and repeated descriptions will be omitted.

As the first preliminary discharging mode, the control device 200 intermittently performs concurrent discharging of ink droplets from the nozzles 21 in the first nozzle row 21A in each discharging cycle T, as illustrated in FIGS. 10 and 11. Specifically, in one of consecutive discharging cycles T, the control device 200 performs concurrent discharging three times in succession by applying the first discharging pulse DP1, second discharging pulse DP2, and third discharging pulse DP3 in the periods T1 to T3. In the next discharging cycle T, the control device 200 performs concurrent non-discharging in which ink droplets are not discharged in the periods T1 to T3. Concurrent discharging and concurrent non-discharging in each discharging cycle T are alternately repeated.

From the nozzles 21 in the second nozzle row 21B as well, the control device 200 intermittently performed concurrent discharging in each discharging cycle T. Specifically, in one of consecutive discharging cycle T, the control device 200 performs concurrent discharging three times in succession by applying the first discharging pulse DP1, second discharging pulse DP2, and third discharging pulse DP3 in the periods T1 to T3. In the next discharging cycle T, the control device 200 performs concurrent non-discharging in which ink droplets are not discharged in the periods T1 to T3. Concurrent discharging and concurrent non-discharging in each discharging cycle T are alternately repeated.

In intermittent concurrent discharging and concurrent non-discharging in the first nozzle row 21A, concurrent discharging or concurrent non-discharging is not performed in succession in the periods T1 to T3, which are consecutive and repeat, in the discharging cycle T. That is, in intermittent concurrent discharging of ink droplets, concurrent discharging of ink droplets is performed after an interval of a certain period in the periods T1 to T3, which are consecutive and repeat. Specifically, even when concurrent discharging of ink droplets is performed in succession in one or two or more of the periods T1 to T3, which are consecutive and repeat, a period in which concurrent non-discharging of ink droplets is performed is interposed between periods in each of which concurrent discharging is performed. Similarly, in intermittent concurrent non-discharging of ink droplets, concurrent non-discharging of ink droplets is performed after an interval of a certain period in the periods T1 to T3, which are consecutive and repeat. Specifically, even when concurrent non-discharging of ink droplets is performed in succession in one or two or more of the periods T1 to T3, which are consecutive and repeat, a period in which concurrent discharging of ink droplets is performed is interposed between periods in each of which concurrent non-discharging is performed.

In this embodiment, in the first nozzle row 21A, concurrent discharging of ink droplets is performed three times in succession in the periods T1 to T3 in one discharging cycle T. In the next discharging cycle T, however, concurrent non-discharging of ink droplets is performed three times in succession in the periods T1 to T3. That is, three executions of concurrent discharging and three executions of concurrent non-discharging are alternately repeated. Therefore, it can be said that concurrent discharging is intermittently performed, and concurrent non-discharging is intermittently performed.

In the second nozzle row 21B as well, concurrent discharging and concurrent non-discharging are intermittently performed similarly.

When concurrent discharging of ink droplets is performed from the nozzles 21 in the first nozzle row 21A as described above, it is possible to suppress the generation of mist due to the generation of a self jet flow resulting from the successive discharging of ink droplets and to suppress the adhesion of mist to the nozzle plate 20. In particular, when one cap 9*a* is provided separately for each head chip 110 as in this embodiment, mist is likely to be generated due to a self jet flow of ink droplets because the area of the cap 9*a* is small and ink is thereby discharged into the cap 9*a* with the carriage 5 stopped. In this embodiment, however, concurrent discharging of ink droplets is intermittently performed, so it is possible to suppress the generation of mist even when one cap 9*a* is provided separately for each head chip 110.

In the discharging cycle T in which concurrent discharging is performed from the nozzles 21 in the first nozzle row 21A three times, concurrent non-discharging from the nozzles 21 in the second nozzle row 21B is performed three times. In the discharging cycle T in which concurrent discharging is performed from the nozzles 21 in the second nozzle row 21B three times, concurrent non-discharging from the nozzles 21 in the first nozzle row 21A is performed three times. That is, concurrent discharging is performed from the nozzles 21 in the first nozzle row 21A after an interval of a certain time, and concurrent discharging is performed from the nozzles 21 in the second nozzle row 21B while concurrent discharging from the nozzles 21 in the first nozzle row 21A is stopping. Similarly, concurrent discharging is performed from the nozzles 21 in the second nozzle row 21B after an interval of a certain time, and concurrent discharging is performed from the nozzles 21 in the first nozzle row 21A while concurrent discharging from the nozzles 21 in the second nozzle row 21B is stopping. That is, the first nozzle row 21A and second nozzle row 21B mutually complement timings at which to discharge ink droplets.

Since the first nozzle row 21A and second nozzle row 21B mutually complement timings at which to discharge ink droplets as described above, ink droplets are not discharged from the nozzles 21 in the first nozzle row 21A and second nozzle row 21B at the same timing. Therefore, the number of nozzles 21, in the first nozzle row 21A and second nozzle row 21B, from which ink droplets are discharged at the same time can be reduced, making it possible to suppress the generation of mist. In particular, since the first nozzle row 21A and second nozzle row 21B are disposed in the same head chip 110, they are placed close to each other and discharge ink droplets into the same cap 9*a*. Therefore, when the number of nozzles 21, in the first nozzle row 21A and second nozzle row 21B, from which ink droplets are discharged at the same time is reduced, the generation of mist can be efficiently suppressed.

Since, in this embodiment, the first nozzle row 21A and second nozzle row 21B mutually complement timings at which to discharge ink droplets, as described above, even when ink droplets are intermittently discharged from the nozzles 21 in the first nozzle row 21A and second nozzle row 21B, it is possible to restrain a time needed for preliminary discharging in the first preliminary discharging mode from being greatly prolonged.

Here, it will be assumed that, in preliminary discharging in the comparative example, discharging of ink droplets is performed from the nozzles 21 in the first nozzle row 21A in succession in 200,000 discharging cycles and from the nozzles 21 in the second nozzle row 21B in succession in 200,000 discharging cycles, a total of 400,000 discharging cycles, as illustrated in FIG. 10. In preliminary discharging in this embodiment, to discharge the same amount of ink as in the comparative example from the first nozzle row 21A and second nozzle row 21B, twice as many discharging cycles as in the comparative example are needed for each of the first nozzle row 21A and second nozzle row 21B. Specifically, a total of 400,000 discharging cycles are needed for the first nozzle row 21A, and a total of 400,000 discharging cycles are needed for the second nozzle row 21B. In this embodiment, however, since the first nozzle row 21A and second nozzle row 21B mutually complement timings at which to discharge ink droplets, the number of discharging cycles can be reduced by half. In this embodiment as well, therefore, the same amount of ink droplets as in the comparative example can be discharged in the same number of discharging cycles as in the comparative example, that is, 400,000 discharging cycles.

Accordingly, the generation of mist can be suppressed, and a time needed for the first preliminary discharging mode can be shortened. This can suppress the drying of the ink in the cap 9*a* and a prolonged downtime to the execution of the next printing, which are caused when a time needed for preliminary discharging is long.

When concurrent discharging is performed from the nozzles 21 in each nozzle row, it is possible to suppress a drop in the flying speed of ink droplets. With the recording head 1 that has partition walls 11 separating pressure generating chambers 12 and also has the vibrating plate 50, which is a movable wall passing over the partition walls 11, the vibrating plate 50 causing a pressure change in the ink in the pressure generating chamber 12, as in this embodiment, another point to note is that when a timing at which to discharge ink droplets from the nozzles constituting a nozzle row is shifted without concurrent discharging being performed, a pressure change does not occur in adjacent pressure generating chambers 12 separated by the partition wall 11 at the same time, so the partition wall 11 is deformed and eliminates the pressure change in one pressure generating chamber 12, lowering the flying speed of ink droplets. When the flying speed of ink droplets is lowered like this, the amount of generated mist is increased. In this embodiment, however, even when the recording head 1 is structured so as to have partition walls 11 and the vibrating plate 50, which is a movable wall passing over the partition walls 11, a pressure change occurs in the pressure generating chambers 12 separated by the partition walls 11 at the same time. Therefore, it is possible to restrain pressure from being eliminated by the deformation of the partition wall 11. This can suppress a drop in the flying speed of ink droplets, which is caused by the elimination of pressure by the partition wall 11. Therefore, it is possible to reduce the amount of mist generated due to a drop in the flying speed of ink droplets.

Example of Test

Figure 12:
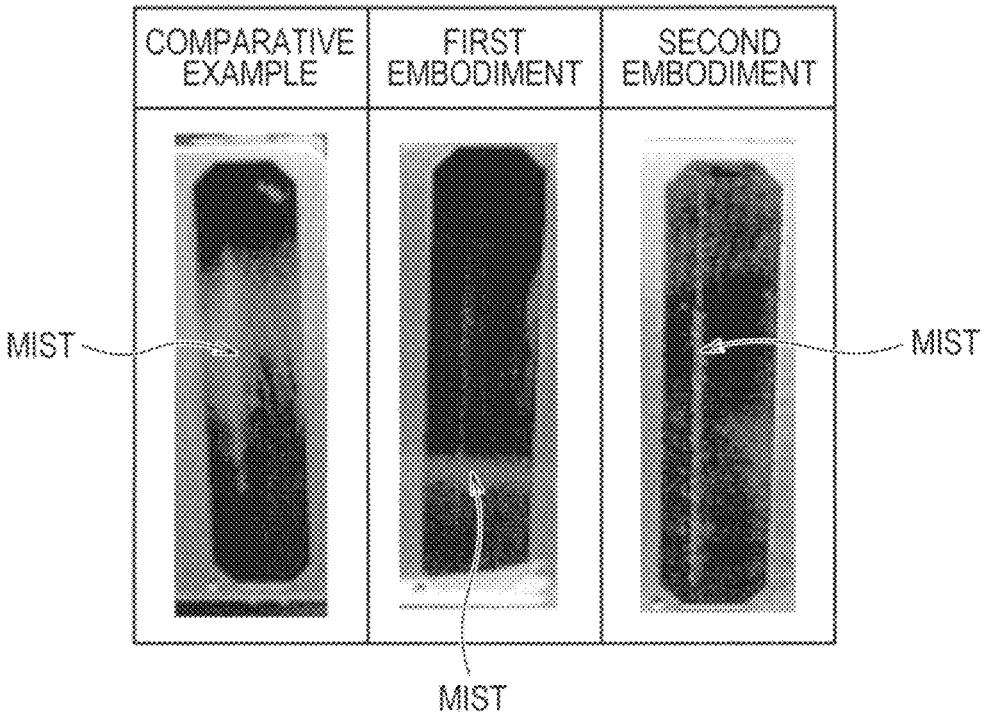
FIG. 12 illustrates images of nozzle plates indicating test results in a test example.

Preliminary discharging in the comparative example, first embodiment, and second embodiment was performed to measure the state of mist that adhered to the nozzle plate 20. Specifically, in the recording head 1 described above, the distance between the first nozzle row 21A and the second nozzle row 21B was set to 1/10 inch, a pitch between nozzles 21 in the first nozzle row 21A and second nozzle row 21B was set to 1/360 inch, the discharging cycle was set to 14.4 kHz (69.4 μs), and the weight of an ink droplet discharged in response to one discharging pulse was set to 7 ng. Under these conditions, ink droplets were discharged into the cap 9*a* with the discharging patterns and discharging cycles indicated in the table in FIG. 10. That is, in the first preliminary discharging mode in the first embodiment, the discharging frequency in each nozzle row per unit time was 14.4 times/ms, and the discharging count in each nozzle row per intermittent cycle was 1. In the first preliminary discharging mode in the second embodiment, the discharging frequency in each nozzle row per unit time was 21.6 times/ms, and the discharging count in each nozzle row per intermittent cycle was 3. As a comparative example for these embodiments, preliminary discharging was performed 600,000 times (600,000 shots) at a discharging frequency of 43.2 times/ms without a non-discharging period being interposed (that is, non-intermittently). FIG. 12 illustrates images obtained by photography of the nozzle plate 20 after preliminary discharging in the comparative example, first embodiment, and second embodiment.

In the comparative example, a large amount of mist adhered to the liquid ejection surface 20*a* of the nozzle plate 20, as illustrated in FIG. 12. In the first and second embodiments, however, the amount of mist that adhered to the liquid ejection surface 20*a* of the nozzle plate 20 could be made smaller than in the comparative example.

In preliminary discharging in the first preliminary discharging mode, therefore, the discharging frequency of ink droplets in each nozzle row per unit time is 22 times/ms or less and is more preferably 15 times/ms or less. The discharging count in each nozzle row per intermittent cycle is 3 or less and is preferably 1 or less.

Furthermore, in the first preliminary discharging mode in the first embodiment, the amount of mist that adhered to the nozzle plate 20 could be made smaller than in the second embodiment. A possible reason for this is that since the discharging frequency of ink droplets in each nozzle row per unit time in the first embodiment was lower than in the second embodiment and the discharging frequency of ink droplets in a combination of the first nozzle row 21A and the second nozzle row 21B per unit time in the first embodiment was also lower tan in the second embodiment, the amount of generated mist was small. In the second embodiment, however, a time needed in the first preliminary discharging mode can be made shorter than in the first embodiment.

As described above, in the ink jet recording apparatus I in the above embodiments, the discharging frequency of ink droplets in each nozzle row per unit time is preferably 22 times/ms or less. According to this, it is possible to suppress the generation of mist due to discharged ink droplets by reducing the discharging frequency.

In the ink jet recording apparatus I in the above embodiments, the discharging count in the first nozzle row 21A and second nozzle row 21B, each of which is a nozzle row, per intermittent cycle is preferably 3 or less. According to this, it is possible to suppress the generation of mist due to discharged ink droplets by reducing the discharging count per intermittent cycle to 3 or less.

Other Embodiments

So far, embodiments of the present disclosure have been described. However, the basic structure in the present disclosure is not limited to the structures described above.

Figure 13:
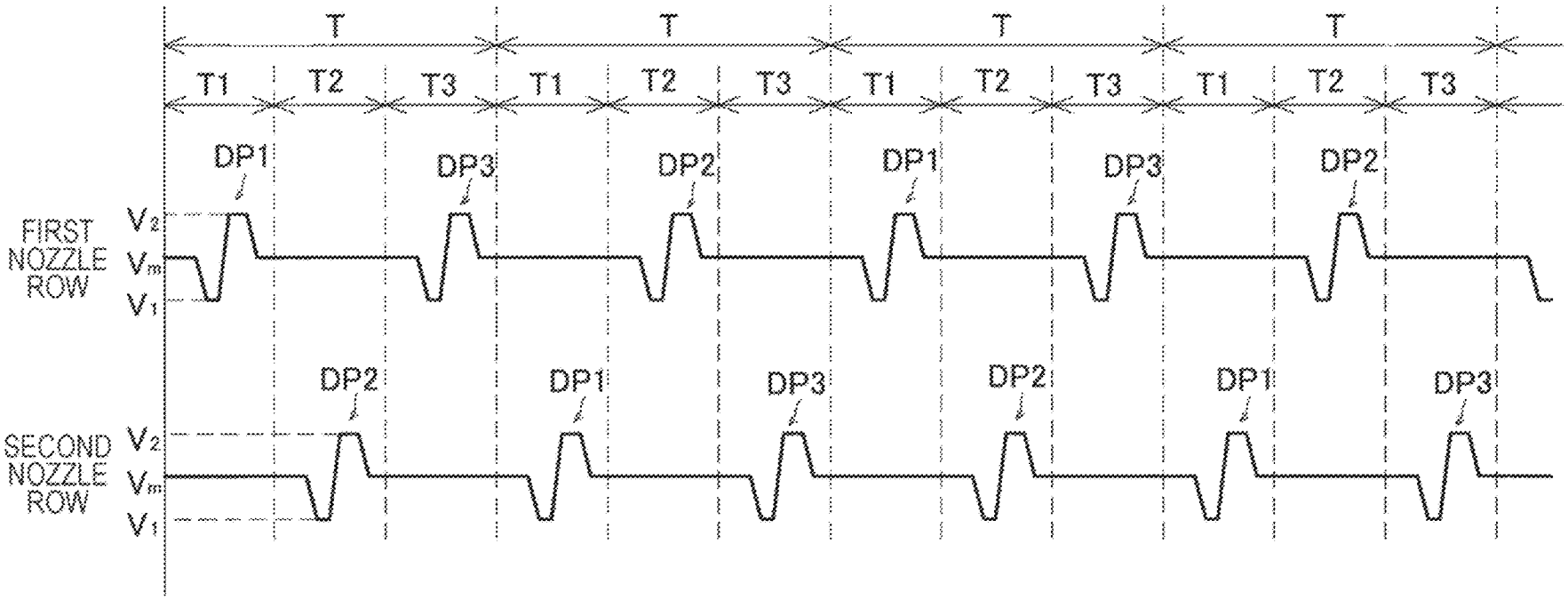
FIG. 13 illustrates driving waveforms indicating pulses to be applied according to another embodiment.

For example, in the first and second embodiments described above, the same pulse has been applied to both the first nozzle row 21A and second nozzle row 21B in each discharging cycle T in the first preliminary discharging mode. However, this is not a limitation. For example, discharging pulses as illustrated in FIG. 13 may be used. That is, in the first nozzle row 21A, concurrent discharging and concurrent non-discharging of ink droplets were alternately repeated in the periods T1 to T3, which are consecutive and repeat, either concurrent discharging or concurrent non-discharging being performed once in each period, as illustrated in FIG. 13. In the second nozzle row 21B as well, concurrent discharging and concurrent non-discharging of ink droplets were alternately repeated in the periods T1 to T3, which are consecutive and repeat, either concurrent discharging or concurrent non-discharging being performed once in each period in a similar manner. Then, the first nozzle row 21A and second nozzle row 21B mutually complemented timings at which to discharge ink droplets.

In this structure, a time needed for preliminary discharging in the comparative example is 200,000 discharging cycles in the first nozzle row 21A and 200,000 discharging cycles in the second nozzle row 21B, totaling 400,000 discharging cycles. By comparison, a time needed in the first preliminary discharging mode illustrated in FIG. 13 is 400,000 discharging cycles in the first nozzle row 21A, twice as many as in the comparative example, and 400,000 discharging cycles in the second nozzle row 21B, twice as many as in the comparative example. However, since the first nozzle row 21A and second nozzle row 21B mutually complement timings at which to discharge ink droplets, discharging from the first nozzle row 21A and discharging from the second nozzle row 21B can be carried out at the same time. Therefore, preliminary discharging can be performed in half the total, that is, 400,000 discharging cycles, as illustrated in FIG. 10. According to this, preliminary discharging illustrated in FIG. 13 can be performed in a time shorter than in the comparative example. In addition, since the number of nozzles 21 from which ink droplets are discharged at the same time is small and concurrent discharging is intermittently performed from the same nozzles 21 without being performed in succession, the generation of mist can be suppressed.

For example, in the first and second embodiments described above, a structure has been exemplified in which the first nozzle row 21A and second nozzle row 21B have been arranged side by side in the second direction Y. However, this is not a limitation. For example, the first nozzle row 21A and second nozzle row 21B may be arranged side by side in the first direction X. In this case, the manifolds 100 only need to be separated with respect to the first direction X. Alternatively, nozzles 21 may be formed so that the first nozzle row 21A and second nozzle row 21B may be placed in a staggered arrangement.

In the first and second embodiments described above, the driving signal COM has been exemplified as having the first discharging pulse DP1, second discharging pulse DP2, and third discharging pulse DP3, which have the same driving waveform, in one discharging cycle T. However, the driving signal COM is not limited to this. At least two of the first discharging pulse DP1, second discharging pulse DP2, and third discharging pulse DP3 may have different driving waveforms. Of course, the number of discharging pulses included in one discharging cycle T of the driving signal COM is not limited to 3. The driving signal COM may have only one discharging pulse or two or more discharging pulses in one discharging cycle T.

In each embodiment described above, the piezoelectric actuator 300 of thin-film type has been described as a pressure generation unit that causes a pressure change in the pressure generating chamber 12. However, this is not a limitation. Other types of piezoelectric actuators can be used. An example of these piezoelectric actuators is a thick-film piezoelectric actuator formed by, for example, a method in which a green sheet is pasted. Another example is a piezoelectric actuator of vertical oscillation type in which a piezoelectric material and an electrode forming material are alternately laminated so that the piezoelectric actuator contracts and extends in the axial direction. Alternatively, other types of actuators can be used as the pressure generation unit. An example of these actuators is such that a heat generating element is placed in the pressure generating chamber and bubbles generated due to heat from the heat generating element are used to discharge liquid droplets from nozzle openings. Another example is a so-called electrostatic actuator or the like in which static electricity is generated between a vibrating plate and an electrode to deform the vibrating plate with an electrostatic force so that liquid droplets are discharged from nozzle openings.

The present disclosure is targeted at many liquid ejecting apparatuses. The present disclosure can also be used in, for example, liquid ejecting apparatuses that have a recording head such as one of various types of ink jet recording heads used in printers and other image recording apparatuses, a color material ejecting head used in the manufacturing of color filters for liquid crystal displays and the like, an electrode material ejecting head used to form electrodes in organic electroluminescence (EL) displays, field emission displays (FEDs), and the like, or a bio-organic substance ejecting head used in the manufacturing of biochips.

What is claimed is:

1. A liquid ejecting apparatus comprising:

a liquid ejecting head having a plurality of nozzle rows in which nozzles that discharge a liquid are arranged in rows;

a pressure generating unit that causes a pressure change in a flow path communicating with the nozzles so that the liquid is discharged from the nozzles;

a cap that covers the plurality of nozzle rows; and a controller that controls driving of the pressure generating unit and causes the liquid to be ejected from the nozzles; wherein the controller carries out preliminary discharging in which the liquid is discharged from the plurality of nozzle rows toward the cap, and the controller controls a first preliminary discharging mode so as to be executable so that, in preliminary discharging from a first nozzle row and a second nozzle row constituting the plurality of nozzle rows, the controller intermittently carries out concurrent discharging and concurrent non-discharging from the nozzles in the first nozzle row and the second nozzle row in such a way that when concurrent discharging is performed from the nozzles in the first nozzle row, concurrent non-discharging from the nozzles in the second nozzle row is performed, and when concurrent discharging is performed from the nozzles in the second nozzle row, concurrent non-discharging from the nozzles in the first nozzle row is performed.

2. The liquid ejecting apparatus according to claim 1, wherein a discharging frequency in the nozzle row per unit time is 22 times/ms or less.

3. The liquid ejecting apparatus according to claim 1, wherein a discharging count in the nozzle row per intermittent cycle is 3 or less.

4. The liquid ejecting apparatus according to claim 1, wherein:

a pressure generating chamber is provided for each nozzle in the nozzle rows so as to communicate with the nozzle;

a plurality of pressure generating chambers communicating with the nozzle row communicate with a common liquid chamber in common; and different common liquid chambers are used as a common liquid chamber corresponding to the first nozzle row and as a common liquid chamber corresponding to the second nozzle row.

5. The liquid ejecting apparatus according to claim 1, wherein the liquid ejecting head has a pressure generating chamber communicating with the nozzle in the nozzle row, a partition wall that separates the pressure generating chamber, and a movable wall extending across partition walls, the movable wall causing a pressure change in a liquid in the pressure generating chamber.

6. The liquid ejecting apparatus according to claim 1, wherein the controller further controls a second preliminary discharging mode, in which preliminary discharging is performed with a second discharging count smaller than a first discharging count in the first preliminary discharging mode, so as to be executable; in the second preliminary discharging mode, discharging from the first nozzle row with the second discharging count and discharging from the second nozzle row with the second discharging count are concurrently performed; alternatively, after discharging from the first nozzle row with the second discharging count, discharging from the second nozzle row is performed with the second discharging count.

7. The liquid ejecting apparatus according to claim 6, wherein a discharging frequency in the nozzle row per unit time in the second preliminary discharging mode is higher than a discharging frequency in the nozzle row per unit time in the first preliminary discharging mode.

* * * * *